US005254433A

United States Patent [19]

Nakamura et al.

[11] Patent Number: 5,254,433

[45] Date of Patent: Oct. 19, 1993

[54] DYE FIXING ELEMENT

[75] Inventors: Yoshisada Nakamura; Nobuo Seto; Masakazu Morigaki, all of Kanagawa, Japan

[73] Assignee: Fuji Photo Film Co., Ltd., Kanagawa, Japan

[21] Appl. No.: 705,205

[22] Filed: May 24, 1991

[30] Foreign Application Priority Data

May 28, 1990 [JP] Japan ..... 2-137884
Sep. 14, 1990 [JP] Japan ..... 2-245813

[51] Int. Cl.[5] ..... G03C 5/54

[52] U.S. Cl. ..... 430/203; 430/213; 430/214; 430/216; 430/218

[58] Field of Search ..... 430/203, 214, 216, 218, 430/213

[56] References Cited

U.S. PATENT DOCUMENTS 4,192,679 3/1980 Erickson ..... 430/214
4,542,092 9/1985 Toya et al. ..... 430/214
4,766,052 8/1988 Nakamura et al. ..... 430/213
4,968,598 11/1990 Nakamura et al. ..... 430/214

FOREIGN PATENT DOCUMENTS 0160947 11/1985 European Pat. Off. .
56-008138 1/1981 Japan .

OTHER PUBLICATIONS

"Photographic Processes and Products", *Research Disclosure* No. 15162.
Patent Abstracts of Japan, vol. 13, No. 502 (p-958) (3850), published Nov. 13, 1989.
Research Disclosure No. 16741, Havant, GB, pp. 32-33, published Mar. 1978.
Patent Abstracts of Japan, vol. 5, No. 52 (P-56) (724), published Apr. 11, 1981.

*Primary Examiner*—Richard L. Schilling
*Attorney, Agent, or Firm*—Sughrue, Mion, Zinn, Macpeak & Seas

[57] ABSTRACT

A dye fixing element to which a diffusible dye is transferable, the dye having been formed or released during development, either after or at the same time as image-wise exposure of a photosensitive element, which photosensitive element comprises a photosensitive silver halide, a binder and a dye providing compound which forms or releases a diffusible dye in correspondence or counter-correspondence to the exposure, wherein the dye fixing element comprises at least one compound represented by general formula (I):

(I)

wherein $R^1$, $R^2$, $R^3$ and X are as defined in the specification.

6 Claims, No Drawings

DYE FIXING ELEMENT

FIELD OF THE INVENTION

This invention relates to a dye fixing element for use in a color diffusion transfer process.

BACKGROUND OF THE INVENTION

In comparison with other photographic processes, for example electrophotographic processes and diazo photographic processes, photographic processes in which silver halides are used provide superior photographic characteristics, such as photographic speed and gradation control, and so they have been used in the widest range of applications.

The general field of silver halide photographic processes includes wet processing-type color diffusion transfer methods in which a dye fixing element having a dye fixing layer is laminated with a photosensitive element having a silver halide emulsion layer. In some cases an alkaline processing composition is spread in the form of a layer within this laminate, while in others the laminate is immersed in an alkaline processing fluid.

Recently, methods have been developed in which diffusible dyes are produced or released in correspondence with or in counter-correspondence to the reduction reaction that occurs when a photosensitive silver halide and/or organic silver salt is reduced to silver by thermal development. The diffusible dyes so produced or released are transferred to a dye fixing element. Such methods are disclosed, for example, in U.S. Pat. Nos. 4,463,079, 4,474,867, 4,478,927, 4,507,380, 4,500,626 JP-A-59-168439, -59-17483, and 4,483,914 JP-A-58-149046, JP-A-58-149047, JP-A-59-152440, JP-A-59-154445, JP-A-59-165054, JP-A-59-180548, JP-A-59-168439, JP-A-59-174832, JP-A-59-174833, JP-A-59-174834, JP-A-59-174835, JP-A-62-65038, JP-A-61-23245, and European Patents 210,660A2 and 220,746A2. (The term "JP-A" as used herein signifies an "unexamined published Japanese patent application".)

However, there are problems associated with the above methods of image formation in that the reflection density in the white base parts is initially high after image formation, and it tends to increase on ageing.

SUMMARY OF THE INVENTION

An object of the present invention is to provide dye fixing elements for diffusion transfer processes in which the change with time of the density of the image as viewed against the white base parts is slight.

This object has been realized by using a dye fixing element to which a diffusible dye is transferable, the dye having been formed or released during development, either after or at the same time as imagewise exposure of a photosensitive element, which photosensitive element comprises a photosensitive silver halide, a binder and a dye providing compound which forms or releases a diffusible dye in correspondence or counter-correspondence to the exposure, and wherein the dye fixing element comprises at least one compound represented by general formula (I):

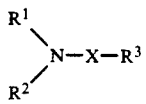

(I)

where, $R^1$, $R^2$ and $R^3$, which may be the same or different, each represents a hydrogen atom, an alkyl group, an alkenyl group, an alkynyl group, an aryl group,

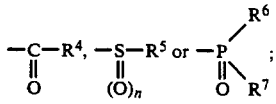

X represents —O—, —S— or

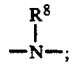

$R^4$, $R^5$, $R^6$ and $R^7$ each represents an alkyl group, an alkenyl groups, an alkynyl group, an aryl group, an alkoxy group, an aryloxy group or an amino group. Moreover, n represents 1 or 2; $R^8$ has the same meaning as $R^3$;

when X represents —O— or —S—, $R^1$ and $R^3$, or $R^2$ and $R^3$, may join together to form a five-membered to seven-membered ring, and when X represents —S— or

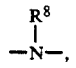

$R^1$ and $R^2$, or $R^3$ and $R^8$, may join together to form a five-membered to seven-membered ring;

and wherein, the total number of carbon atoms in the compound represented by general formula (I) is at least 6.

DETAILED DESCRIPTION OF THE INVENTION

General formula (I) is described in detail below.

$R^1$, $R^2$ and $R^3$, which may be the same or different, each represents a hydrogen atom, an alkyl group, an alkenyl group, an alkynyl group, an aryl group,

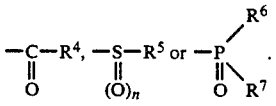

X represents —O—, —S— or

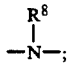

$R^4$, $R^5$, $R^6$ and $R^7$ each represents an alkyl group, an alkenyl group, an alkynyl group, an aryl group, an alkoxy group, an aryloxy group, or an amino group. Moreover, n represents 1 or 2. $R^8$ has the same meaning as $R^3$.

In general formula (I), these substituent groups may have substitutable substituent groups, and the alkyl groups may be, for example, methyl, ethyl, isopropyl, tert-octyl, benzyl, 2-ethylhexyl, hexadecyl, hexyloxyethyl, octylsulfonylethyl, cyclohexyl or ethoxyethyl groups; the alkenyl groups may be, for example, vinyl, allyl or cyclohexenyl groups; the alkynyl groups may be, for example, ethynyl or 2-propynyl groups; the aryl groups may be, for example, phenyl, 4-dodecyloxyphenyl or naphthyl groups; the alkoxy groups may be, for example, methoxy, ethoxy, octyloxy, cyclohexyloxy, butoxy, ethoxy or hexadecyloxyethoxy groups; the aryloxy groups may be, for example, phenoxy, 4-dodecyloxyphenoxy, 3-chlorophenoxy or 4-tert-butylphenoxy groups; and the amino groups may be, for example, amino, diethylamino, ethylamino, octylamino or 2-ethylhexyloxypropylamino groups.

When X represents —O— or —S—, $R^1$ and $R^3$, or $R^2$ and $R^3$, may join together to form a five-membered to seven-membered ring (for example, a tetrahydroisoxazole ring), and when X represents —S— or

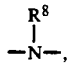

$R^1$ and $R^2$, or $R^3$ and $R^8$, may join together to form a five-membered to seven-membered ring (for example, a piperazine ring, a piperidine ring or a morpholine ring).

The total number of carbon atoms in the compound represented by general formula (I) is at least 6, and preferably at least 10.

From among the compounds represented by general formula (I), those in which X represents —O— are preferred, and those in which —X—$R^3$ represents —OH are especially preferred.

Actual examples of compounds represented by general formula (I) which can be used in the present invention are shown below, but the invention is not limited by these examples.

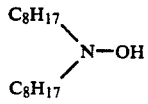

(1)

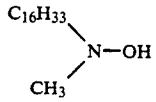

(2)

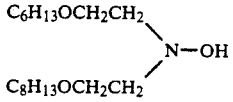

(3)

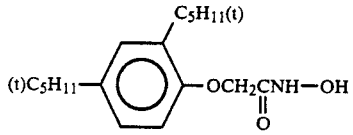

(4)

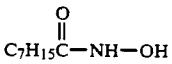

(5)

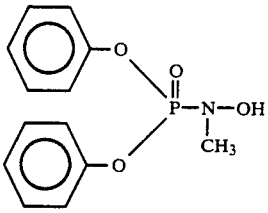

(6)

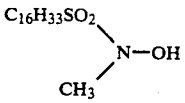

(7)

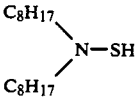

(8)

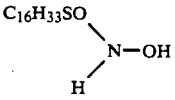

(9)

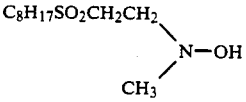

(10)

-continued
(11)
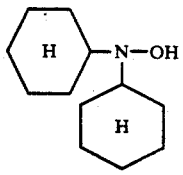
(12)
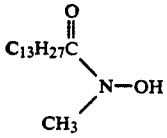
(13)
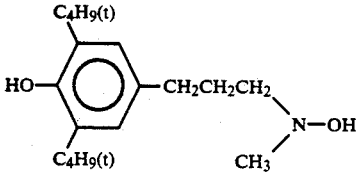
(14)
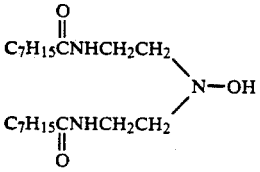
(15)
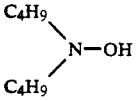
(16)
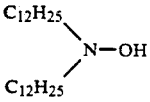
(17)
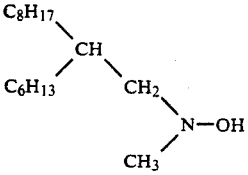
(18)
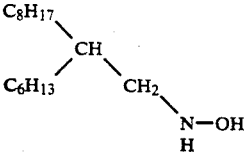
(19)
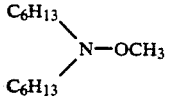
(20)
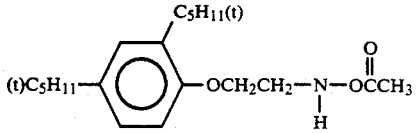
(21)
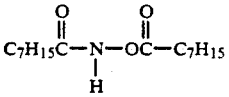

-continued
(22)
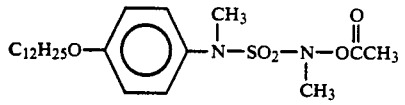
(23)
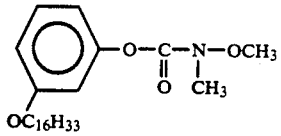
(24)
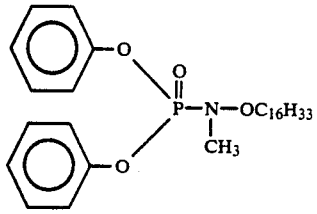
(25)
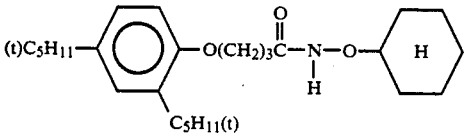
(26)
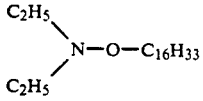
(27)
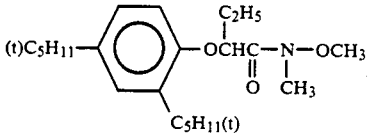
(28)
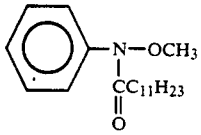
(29)
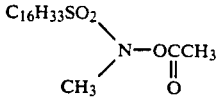
(30)
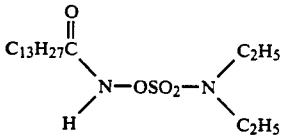
(31)
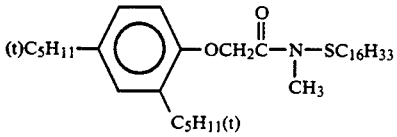
(32)
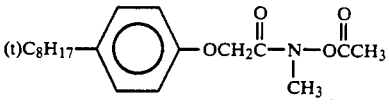

-continued
(33)
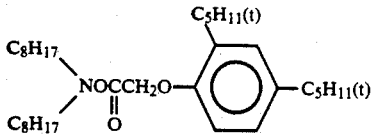
(34)
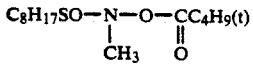
(35)
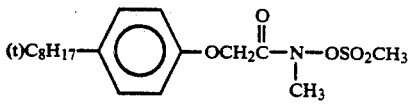
(36)
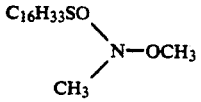
(37)
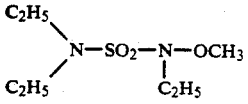
(38)
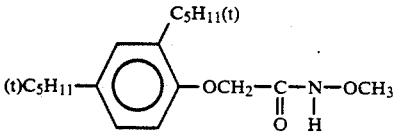
(39)
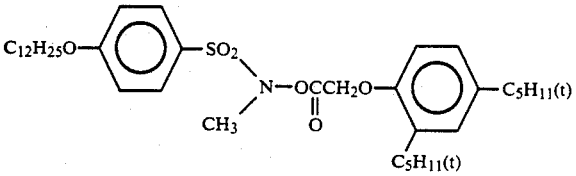
(40)
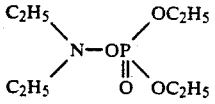
(41)
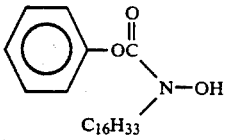
(42)
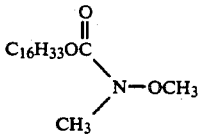
(43)
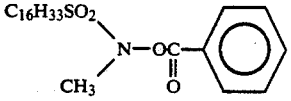
(44)
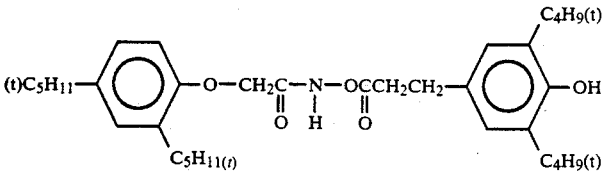

-continued
(45)
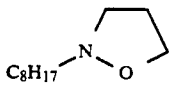
(46)
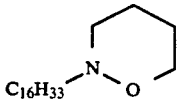
(47)
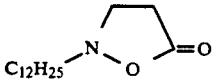
(48)
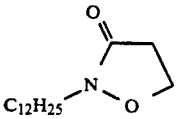
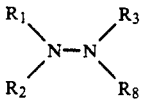
| Compound number | $R^1$ | $R^2$ | $R^3$ | $R^4$ |
|---|---|---|---|---|
| (49) | $CH_3C(=O)-$ | $CH_3$ | $C_{13}H_{27}C(=O)-$ | $CH_3-$ |
| (50) | $C_6H_{13}SO_2C_2H_4-$ | $CH_3-$ | $CH_3C(=O)-$ | $CH_3-$ |
| (51) | $C_4H_9-$ | $C_4H_9-$ | 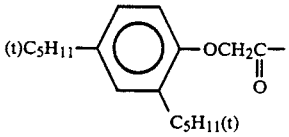 | $C_4H_9-$ |
| (52) | 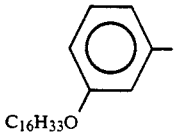 | $CH_3-$ | $(t)C_4H_9C(=O)-$ | H |
| (53) | $C_2H_5OC_2H_4O-C_2H_4-$ | $CH_3-$ | $(t)C_4H_9C(=O)-$ | H |
| (54) | 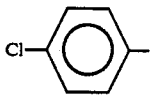 | $CH_3-$ | 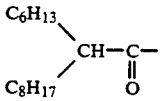 | $CH_3-$ |
| (55) | $CH_2=CH-CH_2-$ | $CH_3-$ | $C_{16}H_{33}SO_2-$ | $CH_3-$ |
| (56) | $CH_3-$ | $CH_3-$ | $C_{16}H_{33}OC(=O)-$ | $CH_3-$ |
| (57) | $(i)C_3H_7-$ | $C_8H_{17}-$ | 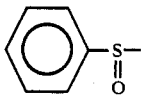 | $C_8H_{17}-$ |

-continued
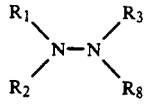
| Compound number | $R^1$ | $R^2$ | $R^3$ | $R^4$ |
|---|---|---|---|---|
| (58) | $C_{12}H_{25}$— | $CH_3$— | $(C_2H_5)_2N$—C(=O)— | $CH_3$— |
| (59) | $C_{12}H_{25}$— | $CH_3$— | $(CH_3)_2N$—$SO_2$— | $CH_3$— |
| (60) | $C_8H_{17}$— | $CH_3$— | 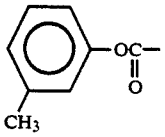 | $CH_3$— |
| (61) | $CH_3$— | $CH_3$— | 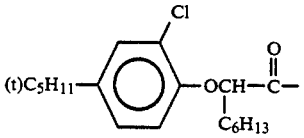 | 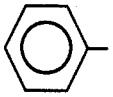 |
| (62) | 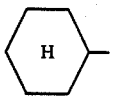 | $CH_3$— | 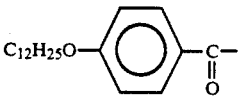 | $CH_3$— |
| (63) | $(t)C_4H_9$— | $CH_3$— | 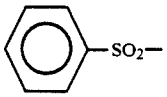 | $C_{12}H_{25}$— |
| (64) | $C_8H_{17}$— | $C_8H_{17}$ | $CH_3$ | $CH_3$ |
| (65) | $C_6H_{13}OCH_2CH_2$— | $CH_3$ | $C_6H_{13}OCH_2CH_2$— | $CH_3$ |
| (66) | 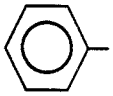 | $CH_3$ | $C_6H_{13}$— | $C_6H_{13}$— |
| (67) | $iC_3H_7$ | $C_8H_{17}$ | $CH_3$ | $CH_3$ |
| (68) | $CH_2{=}CH{-}CH_2$— | $CH_2{=}CH{-}CH_2$— | $CH_3$ | $CH_3$ |
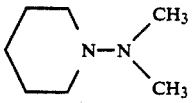
(69)
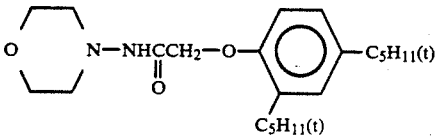
(70)
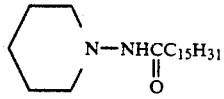
(71)
-continued
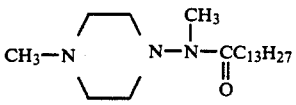
(72)
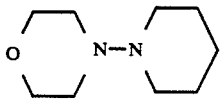
(73)
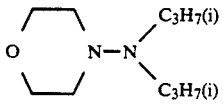
(74)

-continued

(75) 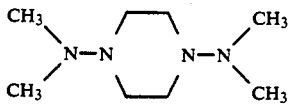

(76) 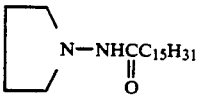

(77) 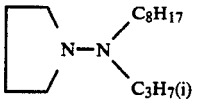

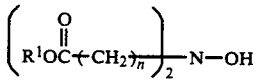

| No. | $R^1$ | n |
|---|---|---|
| (78) | $^nC_4H_9$ | 1 |
| (79) | $^nC_8H_{17}$ | 1 |
| (80) | $^nC_{12}H_{25}$ | 1 |
| (81) | $^nC_4H_9$ | 2 |
| (82) | $^nC_6H_{13}$ | 2 |
| (83) | 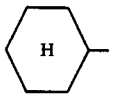 | 2 |
| (84) | $^nC_4H_9CH(C_2H_5)CH_2-$ | 2 |
| (85) | $^nC_8H_{17}$ | 2 |
| (86) | $^nC_{12}H_{25}$ | 2 |
| (87) | $^nC_{16}H_{33}$ | 2 |
| (88) | $^nC_6H_{13}$ | 3 |
| (89) | $^nC_{12}H_{25}$ | 3 |
| (90) | $^nC_{16}H_{33}$ | 3 |

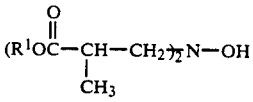

| | $R^1$ |
|---|---|
| (91) | $^nC_4H_9$ |
| (92) | 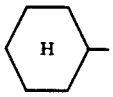 |
| (93) | $^nC_8H_{17}$ |
| (94) | $^nC_{12}H_{25}$ |
| (95) | $^nC_{16}H_{33}$ |
| (95a) | $^nC_4H_9CH(C_2H_5)CH_2$ |
| (95b) | $^nC_{18}H_{37}$ |

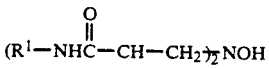

-continued

| | $R^1$ |
|---|---|
| (96) | $^nC_8H_{17}$ |
| (97) | $^nC_{12}H_{25}$ |
| (98) | $(^nC_{12}H_{25}SO_2CH_2CH_2)_2NOH$ |
| (99) | $(^nC_{16}H_{33}OCH_2CH_2)_2NOH$ |

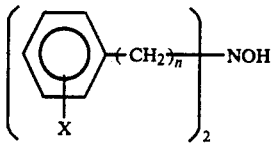

| No. | X | n |
|---|---|---|
| (100) | H | 1 |
| (101) | H | 2 |
| (102) | H | 3 |
| (103) | P—$^{(i)}C_3H_7$ | 2 |
| (104) | P—$CH_3SO_2$— | 2 |

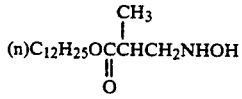

(105)

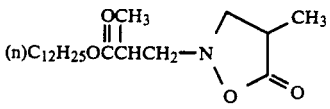

(106)

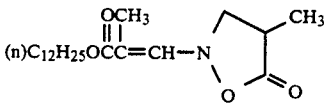

(107)

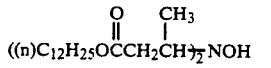

(108)

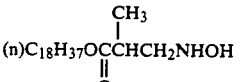

(109)

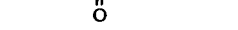

(110)

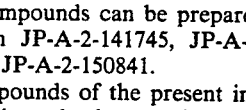

(111)

These compounds can be prepared by the methods disclosed in JP-A-2-141745, JP-A-2-148034, JP-A-2-148035 and JP-A-2-150841.

The compounds of the present invention should be introduced into the layers of the dye fixing element using an oil protecting method.

For example, the method disclosed in U.S. Pat. No. 2,322,027 can be used in practice. In this method, the compound is dissolved in a high boiling point organic solvent such as, for example, an alkyl ester of phthalic acid (for example, dibutyl phthalate, dioctyl phthalate), a phosphoric acid ester (for example, tricresyl phosphate, dioctyl butyl phosphate), a citric acid ester (for example, tributyl acetylcitrate), a benzoic acid ester (for example, octyl benzoate), an alkylamide (for example, diethyl laurylamide), a fatty acid ester (for example, dibutoxyethyl succinate), a trimesic acid ester (for example, tributyl trimesitate) or a chlorinated paraffin (for example, "Enpara 40" (trade name) made by Ajinomoto Co., Inc.), or the compound is dissolved in a high boiling point organic solvent with the conjoint use of a low boiling point organic solvent of boiling point from about 30° C. to 150° C. such as, for example, a lower alkyl acetate (for example, ethyl acetate, butyl acetate), ethyl propionate, sec-butyl alcohol, methyl isobutyl ketone, cyclohexanone or methyl cellosolve acetate, as required, after which the solution is dispersed in a hydrophilic colloid and used in the form of an emulsified dispersion.

The use of phthalic acid esters, benzoic acid esters, alkylamides, fatty acid esters and chlorinated paraffins as high boiling point organic solvents is preferred. The use of chlorinated paraffins is especially desirable. The size of the oil droplets in the oil protecting method is most desirably from 0.02 μm to 1.0 μm.

In those cases where the oil protecting method is used, other photographically useful compounds (for example, anti-color fading agents, fluorescent whiteners, other antistaining agents and film property stabilizers) are preferably included in the same oil droplets.

Furthermore, the method of dispersion with polymers as described hereinafter and the method of dispersion as fine particles in a binder can also be used.

The amount of the compounds of the present invention used is preferably such that the amount finally present in the dye fixing element is from 0.1 to 500 mg/m$^2$, and most desirably from 2 to 200 mg/m$^2$.

The dye fixing element of the present invention is established in a laminar relationship with a photosensitive element at least during the transfer of diffusible dye. That is to say, the dye fixing element is located such that the coated surface of the dye fixing layer side is in face-to-face contact with the coated surface of the photosensitive layer side of the photosensitive element at least during the transfer of diffusible dye.

The dye fixing element of the present invention may be coated onto a separate support from the photosensitive element or it may be coated onto the same support as the photosensitive element. The relationships disclosed in column 57 of U.S. Pat. No. 4,500,626 can also be used in the present invention with respect to the positioning of the photosensitive element, the dye fixing element, the support, and a dye reflecting layer. In the present invention, it is preferred that the dye fixing element be coated on a separate support from the photosensitive element.

The dye fixing element comprises a dye fixing layer on a support, and auxiliary layers such as protective layers, peel-apart layers, anti-curl layers, and backing layers can also be employed, as required. Protective and backing layers are particularly useful. Examples of compounds which may be included in one or more of the above mentioned layers include hydrophilic thermal solvents, plasticizers, anti color fading agents, UV absorbers, slip agents, matting agents, anti-oxidants and dispersed vinyl compounds for increasing dimensional stability.

In the present invention, the dye fixing layer contains a polymer mordant capable of fixing the mobile dyes which are released by development.

The polymer mordant as referred to herein is a polymer containing tertiary amino groups, a polymer having nitrogen-containing heterocyclic groups, or a polymer containing quaternary cations of these groups. The polymer mordants are preferably mixed with other hydrophilic polymers (for example gelatin) for use.

Polymer mordants containing vinyl monomer units having tertiary amino groups are disclosed, for example, in JP-A 60-60643 and JP-A-60-57836, and actual examples of polymers containing vinyl monomer units having tertiary imidazole groups are disclosed, for example, in JP-A-60-118834, JP-A-60-122941, JP-A-62-244043, JP-A 62-244036, and U.S. Pat. Nos. 4,282,305, 4,115,124 and 3,148,061.

Actual preferred examples of polymer mordants containing vinyl monomer units having quaternary imidazolium salts have been disclosed, for example, in British Patents 2,056,101, 2,093,041 and 1,594,961, U.S. Pat. Nos. 4,124,386, 4,115,124, 4,237,853 and 4,450224, and JP-A-48-28225.

Actual preferred examples of polymer mordants containing vinyl monomer units having other quaternary ammonium salts have been disclosed, for example, in U.S. Pat. Nos. 3,709,690, 3,898,088 and 3,958,995, JP-A-60-57836, JP-A-60-60643, JP-A-60-122940, JP-A-60-122942 and JP-A-60-235134.

The molecular weight of the polymer mordants used in the present invention is preferably from 1,000 to 1,000,000, and most desirably from 10,000 to 200,000. These polymer mordants can be used conjointly with hydrophilic colloids which act as binders in the mordant layers of the dye fixing element, as described below.

The mixing ratio of polymer mordant and hydrophilic colloid and the coated weight of polymer mordant can be determined easily by those skilled in the art in accordance with the amount of dye which is to be mordanted, the type and composition of the polymer mordant, and the method of image formation which is being used, but a mordant/hydrophilic colloid ratio (by weight) of from 20/80 to 80/20, and a coated weight of polymer mordant of from about 0.2 g/m$^2$ to about 15 g/m$^2$, and preferably from 0.5 g/m$^2$ to 8 g/m$^2$, are appropriate.

It is possible to increase the dye transfer density by using a metal ion conjointly with the polymer mordant in the dye fixing element. The metal ion can be added to the mordant layer or to a layer which is in close proximity thereto (this may be on the side closer to, or further from, the support which carries the mordant layer). The metal ions are preferably colorless and stable under heat and light. That is to say, polyvalent ions of transition metals, such as $Cu^{2+}$, $Zn^{2+}$, $Ni^{2+}$, $Pt^{2+}$, $Pd^{2+}$and $Co^{3+}$ions, are preferred. $Zn^{2+}$ions ar especially preferred. These metal ions may be generally added in the form of water soluble compounds, for example as $ZnSO_4$ or $Zn(CH_3CO_2)_2$, and the addition of an amount of from about 0.01 g/m$^2$ to about 5 g/m$^2$ is appropriate, and the addition of an amount of from 0.1 g/m$^2$ to 1.5 g/m$^2$ is preferred.

Hydrophilic polymers can be used as binders in the layers to which these metal ions are added. The hydrophilic colloids listed below as actual examples are useful as hydrophilic binders.

The mordant layer containing the polymer mordant may contain various surfactants to improve coating properties.

The dye fixing element of the present invention may contain water soluble bases and/or base precursors for the purpose of promotion of dye transfer or development.

Suitable water soluble inorganic bases include alkali metal and quaternary alkyl ammonium hydroxides, carbonates, bicarbonates, borates, di- and triphosphates and metaborates. Suitable water soluble organic bases include aliphatic amines, aromatic amines, heterocyclic amines, amidines, cyclic amidines, guanidines and cyclic guanidines, and the carbonates, bicarbonates, borates, and di- and triphosphates thereof.

Base precursors suitable for use in the present invention are precursors of the aforementioned organic bases. Here, the base precursor is a compound which releases a basic component on thermal decomposition or electrolysis. Suitable base precursors include the salts of the aforementioned bases and thermally degradable organic acids such as trichloroacetic acid, cyanoacetic acid, acetoacetic acid and α-sulfonylacetic acid, and the salts with 2-carboxycarboximide disclosed in U.S. Pat. No. 4,088,496. The base precursors disclosed, for example, in British Patent 998,945, U.S. Pat. No. 3,220,846 and JP-A-50-22625 can also be used.

Examples of base precursor compounds which form bases on electrolysis are indicated below. The electrolysis of various fatty acid salts can be cited as being typical of the method in which electrolytic oxidation is used. For example, the carbonates of alkali metals and organic bases such as guanidines and amidines can be obtained with very high efficiency by means of such a reaction. Furthermore, methods in which electrolytic reduction is used include the formation of amines by the reduction of nitro or nitroso compounds; the formation of amines by the reduction of nitriles; and the formation of p-aminophenols, p-phenylenediamines and hydrazines by the reduction of nitro compounds, azo compounds and azoxy compounds. p-Aminophenols, p-phenylenediamines and hydrazines can be used not only as bases but also as direct color image forming substances. Furthermore, use can also be made of alkali components which have been formed by the electrolysis of water in the presence of various inorganic salts.

Moreover, methods in which water soluble bases are formed by the reaction of (a) a compound (such as guanidine picolinate, for example) which can undergo a complex-forming reaction, with water as a medium, with (b) the metal ions from which a sparingly soluble metal salt compound (for example, zinc oxide or basic zinc carbonate, calcium carbonate) is constructed can also be used. This method can be such that a dispersion of the sparingly soluble metal salt compound is included in the photosensitive element and a water soluble compound which can undergo a complex-forming reaction with the metal ion is included as a base precursor in the dye fixing element so that the base is formed when a heat treatment is carried out with the two elements in close contact in the presence of water, and this is especially effective from the viewpoint of the ageing storage stability, for example, of the photosensitive element and the dye fixing element.

The bases and/or base precursors may be used individually, or they may be used in combinations of two or more types.

The amount of base and/or base precursor used is from $5\times10^{-4}$ to $5\times10^{-1}$ mol/m$^2$, and preferably from $2.5\times10^{-3}$ to $2.5\times10^{-2}$ mol/m$^2$.

Neutralizing layers and timing layers can be employed in the dye fixing element, as required.

Moreover, in cases where processing is carried out using thermal development there is no need for a particularly high pH value and so there is no need to employ neutralizing layers and timing layers in the dye fixing element.

The photosensitive elements of the present invention are comprised fundamentally of a photosensitive silver halide and a diffusible dye providing compound on a support, and various additives such as reducing agents can be used, as required. These components are often added to the same layer, but if they are in a reactive state they can also be added to separate layers. For example, any loss of speed is avoided if the colored diffusible dye providing compounds are included in a layer below the silver halide emulsion.

In order to obtain a wide range of colors on the chromacity chart using the three primary colors yellow, magenta and cyan, at least three silver halide emulsion layers which are photosensitive to different spectral regions are combined for use. For example, a blue sensitive layer a green sensitive layer and a red sensitive layer may be combined, or a green sensitive layer, a red sensitive layer and an infrared photo sensitive layer may be combined. The photosensitive layers can be arranged in a variety of known arrangements and orders. Furthermore, each photosensitive layer can be divided into two or more layers, as required.

Various auxiliary layers, such as protective layers, subbing layers, interlayers, yellow filter layers, antihalation layers, backing layers, neutralizing layers, timing layers and peel-apart layers for example, can be employed in the photosensitive element.

Any of the silver halides, including silver chloride, silver bromide, silver iodobromide, silver chlorobromide, silver chloroiodide and silver chloroiodobromide, can be used in the present invention.

The silver halide emulsions used in the present invention may be surface latent image type emulsions or internal latent image type emulsions. Internal latent image type emulsions are combined with nucleating agents or light fogging and used as direct reversal emulsions. Furthermore, so-called core/shell emulsions which have different phases for the interior of the grain and for the grain surface layer can also be used. The silver halide emulsion may be mono-disperse or polydisperse, and mixtures of mono-disperse emulsions can be used. The grain size is from 0.1 to 2 μ, and most desirably from 0.2 to 1.5 μ. The crystal habit of the silver halide grains may be cubic, octahedral, tetradecahedral, tabular with a high aspect ratio or of some other form.

In practice, any of the silver halide emulsions disclosed, for example, in column 50 of U.S. Pat. No. 4,500,626, U.S. Pat. No. 4,628,021, *Research Disclosure* (referred to hereinafter as RD) 17029 (1978), and JP-A-62-253159 can be used.

The silver halide emulsions can be used as they are primitive, but they are generally used after chemical sensitization. The known methods of sulfur sensitization, reduction sensitization, noble metal sensitization and selenium sensitization, for example, can be used individually or in combinations with the emulsions for the normal type of photosensitive element. These methods of chemical sensitization can also be carried out in the presence of a nitrogen-containing heterocyclic compound, as disclosed in JP-A-62-253159.

The coated weight of photosensitive silver halide used in the present invention is from 1 mg to 10 grams per square meter, on a silver basis.

The silver halide used in this invention may be spectrally sensitized with methine dyes or by other means.

The dyes which can be used include cyanine dyes, merocyanine dyes, complex cyanine dyes, complex merocyanine dyes, holopolar cyanine dyes, hemi-cyanine dyes, styryl dyes and hemi-oxonol dyes.

Actual examples of sensitizing dyes include the dyes disclosed, for example, in U.S. Pat. No. 4,617,257, JP-A-59-180550, JP-A-60-140335 and RD 17029 (1978) pages 12–13.

These sensitizing dyes can be used individually, or combinations of these dyes can be used, and combinations of sensitizing dyes are often used to achieve super-sensitization.

Compounds which exhibit super-sensitization, which is to say dyes which themselves have no spectrally sensitizing action or compounds which essentially do not absorb visible light (for example, those disclosed in U S. Pat. No. 3,615,641 and JP-A-63-23145), may be included together with the sensitizing dyes.

These sensitizing dyes may be added to the emulsion before, during or after chemical sensitization, and they may be added before or after nucleus formation for forming the silver halide grains as disclosed in U.S. Pat. Nos. 4,183,756 and 4,225,666. The amount added is generally from about $10^{-8}$ to $10^{-2}$ mol per mol of silver halide.

The diffusible dye providing compounds of the present invention are compounds which produce or release diffusible dyes in correspondence with the reaction, or in counter-correspondence with the reaction, when a silver ion is reduced to silver. These compounds are referred to hereinafter as dye providing compounds.

Examples of dye providing compounds which can be used in the present invention include first of all the coupler compounds which form dyes by means of an oxidative coupling reaction. These couplers may be four-equivalent couplers or two-equivalent couplers, but two-equivalent couplers which have a non-diffusible group as a split-off group and form a diffusible dye by means of an oxidative coupling reaction are preferred. The non-diffusible group may take the form of a polymer chain. Actual examples of color developing agents and couplers have been described in detail in, for example, *The Theory of the Photographic Process,* by T. H. James, fourth edition, pages 291–334 and 354–361, and in JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Furthermore, compounds which have the function of releasing or diffusing diffusible dyes in the form of the image can be cited as another type of dye providing compound. Compounds of this type can be represented by general formula (LI) indicated below.

$$(\text{Dye-Y})_n\text{-Z} \qquad \text{(LI)}$$

Where, Dye represents a dye group (such as a dye group which has been temporarily shifted to the short wavelength side) or a dye precursor group; Y represents a simple bond or a linking group; Z represents a group which produces a difference in the diffusibility of the compound represented by $(\text{Dye-Y})_n$-Z, or which releases Dye and produces a difference in the diffusibilities of the released Dye and $(\text{Dye-Y})_n$-Z, in correspondence or in counter-correspondence with the photosensitive silver salt in which a latent image has been imagewise formed; and n represents 1 or 2, and when n is 2 the two Dye-Y moieties may be the same or different.

Actual examples of dye providing compounds which can be represented by general formula (LI) include the compounds described under the headings (1) to (5) below. Moreover, the compounds described under the headings (1) to (3) below form diffusible dye images in counter-correspondence with the development of the silver halide (positive dye images) and those described under the headings (4) and (5) form diffusible dye images in correspondence with the development of the silver halide (negative dye images).

(1) Dye developing agents in which a dye component is connected with a hydroquinone-based developing agent as disclosed, for example, in U.S. Pat. Nos. 3,134,764, 3,362,819, 3,597,200, 3,544,545 and 3,482,972 can be used. These dye developing agents are diffusible under alkaline conditions but become non-diffusible on reaction with silver halide.

(2) Non-diffusible compounds which release a diffusible dye under alkaline conditions but which lose this ability on reaction with silver halide as disclosed, for example, in U.S. Pat. No. 4,503,137 can also be used. Examples include the compounds which release diffusible dyes by means of an intramolecular nucleophilic displacement reaction disclosed, for example, in U.S. Pat. No. 3,980,479 and the compounds which release diffusible dyes by means of an intramolecular rewinding reaction of an isooxazolone ring as disclosed, for example, in U.S. Pat. No. 4,199,354.

(3) Non-diffusible compounds which react with reducing agents which remain non-oxidized by development and release diffusible dyes as disclosed, for example, in U.S. Pat. No. 4,559,290, European Patent 220,746A2, U.S. Pat. No. 4,783,396 and Kokai Giho 87-6199 can also be used.

Examples include the compounds which release diffusible dyes by means of an intramolecular nucleophilic displacement reaction after reduction disclosed, for example, in U.S. Pat. Nos. 4,139,389 and 4,139,379, JP-A-59-185333 and JP-A-57-84453; the compounds which release a diffusible dye by means of an intramolecular electron transfer reaction after reduction disclosed, for example, in U.S. Pat. No. 4,232,107, JP-A-59-101649, JP-A-61-88257 and RD 24025 (1984); the compounds which release a diffusible dye via single bond cleavage after reduction disclosed, for example, in German Patent 3,008,588A, JP-A-56-142530, and U.S. Pat. Nos. 4,343,893 and 4,619,884; the nitro compounds which release diffusible dyes after accepting an electron disclosed, for example, in U.S. Pat. No. 4,450,223; and the compounds which release diffusible dyes after accepting an electron disclosed, for example, in U.S. Pat. No. 4,609,610.

Furthermore, the compounds which have electron withdrawing groups and an N-X bond (where X represents an oxygen, sulfur or nitrogen atom) within the molecule disclosed, for example, in European Patent 220,746A2, Kokai Giho 87-6199, U.S. Pat. No. 4,783,396, JP-A-63-201653 and JP-A-63-201654; the compounds which have electron withdrawing groups and an $SO_2$—X bond (where X has the same significance as described above) within the molecule disclosed in JP-A-1-26842; the compounds which have electron withdrawing groups and a PO-X bond (where X has the same significance as described above) within the molecule as disclosed in JP-A-63-271344; and the compounds which have electron withdrawing groups and a C—X' bond (where X' is the same as X or —$SO_2$—) disclosed in JP-A-63-271341 are more desirable. Furthermore, the compounds which release diffusible dyes on the cleavage of a single bond after reduction by means of a $\pi$-bond which is conjugated with an electron accepting group disclosed in JP-A-1-161237 and JP-A-1-161342 can also be used.

From among these compounds, those which have an electron withdrawing group and an N-X bond within the molecule are especially desirable. Actual examples include compounds (1)–(3), (7)–(10), (12), (13), (15), (23)–(26), (31), (32), (35), (36), (40), (41), (44), (53)–(59), (64) and (70) disclosed in U.S. Pat. No. 4,783,396 and in European Patent 220,746A2, and compounds (11)–(23) disclosed in Kokai Giho 87-1699.

(4) Compounds which release diffusible dyes by means of a reaction with an oxidized product of a reducing agent, being couplers which have a diffusible dye as a split-off group (DDR couplers). Actual examples include those disclosed in British Patent 1,330,524, JP-B-48-39165 and U.S. Pat. Nos. 3,443,940, 4,474,867 and 4,483,914. (The term "JP-B" as used herein signifies an "examined Japanese patent publication".)

(5) Compounds which are reducing with respect to silver halide or organic silver salts and which release diffusible dyes on reduction (DRR compounds). Other reducing agents cannot be used with these compounds and so there are problems with image staining due to oxidative degradation of the reducing agent and this is undesirable. Actual examples have been disclosed, for example, in U.S. Pat. Nos. 3,928,312, 4,053,312, 4,055,428 and 4,336,322, JP-A-59-65839, JP-A-59-69839, JP-A-53-3819, JP-A-51-104343, RD 17465, U.S. Pat. Nos. 3,725,062, 3,728,113 and 3,443,939, JP-A-58-116537, JP-A-57-179840 and U.S. Pat. No. 4,500,626. Actual examples of DRR compounds include the compounds disclosed in columns 22 to 44 of the aforementioned U.S. Pat. No. 4,500,626, and compounds (1)–(3), (10)–(13), (16)–(19), (28)–(30), (33)–(35), (38)–(40) and (42)–(64) disclosed in the aforementioned U.S. patent are preferred. Furthermore, the compounds disclosed in columns 37–39 of U.S. Pat. No. 4,639,408 can also be used.

Furthermore, the dye-silver compounds in which a dye is bonded to an organic silver salt (*Research Disclosure* May 1978, pages 54–58 for example), the azo dyes which are used in the heat-developable silver dye bleach method (U.S. Pat. No. 4,235,957, *Research Disclosure,* April 1976, pages 30–32 for example), and leuco dyes (U.S. Pat. Nos. 3,985,565 and 4,022,617 for example) can also be used as dye providing compounds in addition to the couplers and compounds of general formula (LI) described above.

Various anti-fogging agents or photographic stabilizers can be used in the present invention. For example, use can be made of the azoles and azaindenes disclosed on pages 24–35 of RD 17643 (1978), the nitrogen-containing carboxylic acids and phosphoric acids disclosed in JP-A-59-168442 or the mercapto compounds and their metal salts as disclosed in JP-A-59-111636, and the acetylene compounds disclosed in JP-A-62-87957.

The use of a hydrophilic binder as the binder in the structural layers of the photosensitive element and dye fixing element is preferred. Examples include those disclosed on pages 26–28 of JP-A-62-253159. In practical terms, transparent or semi-transparent hydrophilic binders are preferred, and examples of these include proteins such as gelatin and gelatin derivatives and other natural compounds such as cellulose derivatives and polysaccharides such as starch, gum arabic, dextran and pluran, and poly(vinyl alcohol), polyvinylpyrrolidone, acrylamide polymers and other synthetic polymeric compounds. Furthermore, the highly water absorbent polymers disclosed, for example, in JP-A-62-245260, which is to say homopolymers of vinyl monomers which have a —COOM group or an —$SO_3M$ group (where M represents a hydrogen atom or an alkali metal) or copolymers of these vinyl monomers, or copolymers of these vinyl monomers with other vinyl monomers (for example, sodium methacrylate, ammonium methacrylate, Sumikagel L-5H made by Sumitomo Chemical Co., Ltd.), can also be used. Two or more of these binders can also be used in combination.

In cases where a system in which a trace of water is supplied and thermal development is carried out is adopted, it is possible by using the polymers which have a high water up-take described above to achieve a rapid take-up of the water. Furthermore, when a polymer which has a high water uptake is used in a dye fixing layer or in a dye fixing layer protective layer, it is possible to prevent the re-transfer of dye from a dye fixing element to another dye fixing element once transfer has been accomplished.

The coated weight of binder in the present invention is preferably not more than 20 grams per square meter, more desirably not more than 10 grams per square meter, and most desirably not more than 7 grams per square meter.

Various polymer latexes can be included in a structural layer (including the backing layers) of a photosensitive element or dye fixing element to improve film properties by providing dimensional stabilization, preventing the occurrence of curl, preventing the occurrence of sticking, preventing the formation of cracks in the film and preventing the occurrence of pressure sensitization and desensitization. Actual examples include the polymer latexes disclosed, for example, in JP-A-62-245258, JP-A-62-136648 and JP A-62-110066. In particular, it is possible to prevent cracking of a mordant layer if a polymer latex which has a low glass transition point (below 40° C.) is used in the mordant layer, and an excellent anti-curl effect can be realized by using a polymer latex which has a high glass transition point in the backing layer.

In cases where the photosensitive element of the present invention is processed by thermal development, organometallic salts can be used conjointly as oxidizing agents along with the photosensitive silver halide. The use of organic silver salts from among these organometallic salts is especially desirable.

The benzotriazoles, fatty acids and other compounds disclosed, for example, in columns 52–53 of U.S. Pat. No. 4,500,626 can be used as organic compounds for forming the above mentioned organic silver salt oxidizing agents. Furthermore, the silver salts of carboxylic acids which have alkynyl groups, such as the silver phenylpropiolate disclosed in JP-A-60-113235, and the silver acetylenes disclosed in JP-A-61-249044, can also be used. Two or more types of organic silver salts can be used conjointly.

The above mentioned organic silver salts can be used conjointly in amounts of from 0.01 to 10 mol, and preferably of from 0.01 to 1 mol, per mol of photosensitive silver halide. The total amount of photosensitive silver halide and organic silver salt coated is suitably from 50 mg to 10 grams per square meter when calculated as silver.

In the present invention, the reducing agent may be incorporated into the photosensitive element or it may be supplied to the photosensitive element (and the dye fixing element) during processing as one component of a processing composition which is contained in a rupturable container. The former embodiment is preferred when processing is carried out with thermal development and the latter embodiment is preferred when processing is carried out at near normal temperature using a so-called color diffusion transfer process.

Any of the reducing agents known in this field can be used. Furthermore, the dye providing compounds which have reducing properties described hereinafter can also be included (other reducing agents can also be used conjointly in this case). Furthermore, reducing agent precursors which themselves have no reducing properties but which achieve reducing properties as a result of the action of a nucleophilic reagent or heat during the development process can also be used.

Examples of reducing agents and reducing agent precursors which can be used in the present invention include the reducing agents and reducing agent precursors disclosed, for example, in columns 49–50 of U.S. Pat. No. 4,500,626, columns 30–31 of U.S. Pat. 4,483,914, U.S. Pat. Nos. 4,330,617 and 4,590,152, pages 17–28 of JP-A-60-140335, JP-A-57-40245, JP-A-56-138736, JP-A-59-178458, J--A-59-53831, JP-A-59-182449, JP-A-59-182450, JP-A-60-119555, JP-A-60-128436 to JP-A-60-128439, JP-A-60-198540, JP-A-60-181742, JP-A-61-259253, JP-A-62-244044, JP-A-62-131253 to JP-A-62-131256, and pages 78–96 of European Patent 220,746A2.

Combinations of various reducing agents such as those disclosed in U.S. Pat. No. 3,039,869 can also be used.

In cases where a reducing agent which is non-diffusible is used, an electron transfer agent and/or an electron transfer agent precursor can be used to promote electron transfer between the non-diffusible reducing agent and the developable silver halide, as required.

Electron transfer agents or precursors thereof can be selected from among the reducing agents and precursors thereof described earlier. The electron transfer agent or precursor thereof preferably has a higher mobility than the non-diffusible reducing agent (electron donor). 1-Phenyl-3-pyrazolidones and aminophenols are especially useful electron transfer agents.

The non-diffusible reducing agents (electron donors) which are used in combination with electron transfer agents should be those from among the aforementioned reducing agents which are, however, essentially immobile in the layers of the photosensitive element, and preferred examples include hydroquinones, sulfonamidophenols, sulfonamidonaphthols, the compounds disclosed as electron donors in JP-A-53-110827 and the dye providing compounds which have reducing properties but which are non-diffusible as described hereinbefore.

The amount of reducing agent added is from 0.001 to 20 mol, and most desirably from 0.01 to 10 mol, per mol of silver.

The hydrophobic additives such as the dye providing compounds and non-diffusible reducing agents can be introduced into the layers of the photosensitive element using known methods such as those described, for example, in U.S. Pat. No. 2,322,027. In this case, high boiling point organic solvents such as those disclosed, for example in JP-A-59-83154, JP-A-59-178451, JP-A 59-178452, JP-A-59-178453, JP-A-178454, JP-A-59-178455 and JP-A-59-178457 can be used conjointly with low boiling point organic solvents of boiling point from 50° C. to 160° C., as required.

The amount of high boiling point organic solvent is not more than 10 grams, and preferably not more than 5 grams, per gram of dye providing compound used. Furthermore, they are suitably used in amounts of not more than 1 cc, preferably not more than 0.5 cc, and most desirably of not more than 0.3 cc, per gram of binder.

The methods of dispersion with polymers disclosed in JP-B-51-39853 and JP-A-51-59943 can also be used.

Compounds which are essentially insoluble in water can be included by dispersion as fine particles in the binder as well as using the methods described above.

Various surfactants can be used when dispersing hydrophobic compounds in a hydrophilic colloid. For example, use can be made of the surfactants disclosed on pages 37–38 of JP-A-59-157636.

Compounds which activate development and at the same time stabilize the image can be used in the photosensitive element in cases where thermal development is used for processing. Actual examples of such compounds whose use is preferred are disclosed in columns 51–52 of U.S. Pat. No. 4,500,626.

High boiling point organic solvents can be used as plasticizers, slip agents or as agents for improving the peeling properties of the photosensitive element and the dye fixing element in the structural layers of the photosensitive elements and dye fixing elements. In practice, use can be made of the solvents disclosed, for example, on page 25 of JP-A-62-253159 and JP-A-62-245253.

Moreover, various silicone oils (all of the silicone oils ranging from dimethylsilicone oil to the modified silicone oils in which various organic groups have been introduced into dimethylsiloxane) can be used for the above mentioned purpose. As an example, the use of the various modified silicone oils described in data sheet P6-18B, "Modified Silicone Oils", put out by the Shin-Etsu Silicone Co., and especially the carboxy modified silicone (trade name X-22-3710), is effective.

Furthermore, the silicone oils disclosed in JP-A-62-215953 and JP-A-63-46449 are also effective.

Anti-color fading agents may be used in the photosensitive elements and dye fixing elements. Anti-oxidants, ultraviolet absorbers and certain types of metal complexes can be used, for example, as anti-color fading agents.

Examples of compounds which are effective as anti-oxidants include chroman based compounds, coumaran based compounds, phenol based compounds (for example, hindered phenols), hydroquinone derivatives, hindered amine derivatives and spiroindane based compounds. Furthermore, the compounds disclosed in JP-A-61-159644 are also effective.

Compounds such as benzotriazole based compounds (for example, U.S. Pat. No. 3,533,794), 4-thiazolidone based compounds (for example, U.S. Pat. No. 3,352,681), benzophenone based compounds (for example, JP-A-46-2784) and the other compounds disclosed, for example, in JP-A-54-48535, JP-A-62-136641 and JP-A-61-88256 can be used as ultraviolet absorbers. Furthermore, the ultraviolet absorbing polymers disclosed in JP-A-62-260152 are also effective.

The compounds disclosed, for example, in U.S. Pat. No. 4,241,155, columns 3–36 of U.S. Pat. No. 4,245,018, columns 3–8 of U.S. Pat. No. 4,254,195, JP-A-62-174741, pages 27–29 of JP-A-61-88256, JP-A-63-199248, JP-A-1-75568 and JP-A-1-74272 can be used as metal complexes.

Examples of useful anti-color fading agents are disclosed on pages 125–137 of JP-A-62-215272.

Anti-color fading agents for preventing the fading of dyes which have been transferred to the dye fixing element may be included beforehand in the dye fixing element or they may be supplied to the dye fixing element from the outside, from a photosensitive element for example.

The above mentioned antioxidants, ultraviolet absorbers and metal complexes may be used in combinations of each type.

Fluorescent whiteners may be used in the photosensitive elements and dye fixing elements. The fluorescent whiteners are preferably incorporated into the dye fixing element or supplied to the dye fixing element from the outside, from a photosensitive element for example. As an example, the compounds disclosed, for example, in chapter 8 of volume V of *The Chemistry of Synthetic Dyes*, by K. Veenkataraman, and JP-A-61-143752, can be used. In more practical terms, use can be made, for example, of stilbene based compounds, coumarin based compounds, biphenyl based compounds, benzoxazolyl based compounds, naphthalimide based compounds, pyrazoline based compounds and carbostyryl based compounds.

Fluorescent whiteners can be used in combination with anti-color fading agents.

The film hardening agents disclosed, for example, in column 41 of U.S. Pat. No. 4,678,739, JP-A-59-116655, JP-A-62-245261 and JP-A-61-18942 can be used as film hardening agents in the structural layers of a photosensitive element and a dye fixing element. In more practical terms, use can be made of aldehyde based film hardening agents (formaldehyde for example), aziridine based film hardening agents, epoxy based film hardening agents

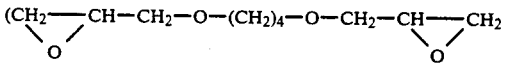

for example), vinylsulfone based film hardening agents (N,N'-ethylene-bis(vinylsulfonylacetamido)ethane for example), N-methylol based film hardening agents (dimethylol urea for example), and polymeric film hardening agents (the compounds disclosed, for example, in JP-A-62-234157).

Various surfactants can be used in the structural layers of the photosensitive element and the dye fixing element as coating promotors, for improving peelability, for improving slip properties, for anti-static purposes or for accelerating development for example. Actual examples of surfactants have been disclosed, for example, in JP-A-62-173463 and JP-A-62-183457.

Organic fluoro compounds may be included in the structural layers of the photosensitive element and the dye fixing element to improve slip properties, to improve peeling properties or for anti-static purposes for example. Typical examples of organic fluoro compounds include the fluorine based surfactants disclosed, for example, in columns 8–17 of JP-B-57-9053, JP-A-61-20944 and JP-A-62-135826, and the oil-like fluorine based compounds such as fluorine oil and hydrophobic fluorine compounds including solid fluorine compound resins such as tetrafluoroethylene resins.

Matting agents can be used in the photosensitive elements and dye fixing elements. As well as the compounds such as silicon dioxide and polyolefin or polymethacrylate disclosed on page 29 of JP-A-61-88256, the compounds disclosed in JP-A-63-274944 and JP-A-63-274952, such as benzoguanamine resin beads, polycarbonate resin beads and AS resin beads, for example, can be used as matting agents.

Furthermore, thermal solvents, anti-foaming agents, biocides and fungicides, and colloidal silica, for example, may be included in the photosensitive element and the dye fixing element. Actual examples of these additives are disclosed on pages 26–32 of JP-A-61-88256.

Image forming accelerators can be used in the photosensitive elements and/or dye fixing elements. The use of image forming accelerators is especially desirable in cases where processing is carried out using thermal development. Image forming accelerators are compounds which function to accelerate the redox reaction of the silver salt oxidizing agents and the reducing agent, to accelerate the reaction which produces a dye from the dye providing substance or breaks down the dye or releases a diffusible dye, and to accelerate the migration of dye from the photosensitive layer to the dye fixing layer. On the basis of their physico-chemical function, image forming accelerators can be divided into the aforementioned bases or base precursors, nucleophilic compounds, high boiling point organic solvents (oils), thermal solvents, surfactants, and compounds which interact with silver or silver ion, for example. However, these groups of substances generally have a complex function and normally combine some of the above mentioned accelerating effects. Details are disclosed in columns 38–40 of U.S. Pat. No. 4,678,739.

Various development terminators can be used in the photosensitive element and/or dye fixing element of the present invention with a view to obtaining a constant image irrespective of fluctuations in the processing temperature and the processing time during development.

The term "development terminator" means a compound which, after proper development, rapidly neutralizes the base or reacts with the base, reduces the base concentration in the film and terminates development, or a compound which interacts with silver and silver salts and inhibits development. In practice, these compounds include acid precursors which release an acid on heating, electrophilic compounds which undergo displacement reactions with bases which are present on heating, and nitrogen-containing heterocyclic compounds, mercapto compounds and precursors of these compounds. Further details are disclosed on pages 31 to 32 of JP-A-62-253159.

Paper and synthetic polymer films are generally used as the support for the photosensitive elements and dye fixing elements of the present invention. In practice, use can be made of supports comprised of poly(ethylene terephthalate), polycarbonate, poly(vinyl chloride), polystyrene, polypropylene, polyimide, cellulose derivatives (for example, triacetyl cellulose) or supports wherein a pigment such as titanium oxide is included within these films. Other supports include film type synthetic papers made for example from polypropylene, mixed papers made from pulp of a synthetic resin such as polyethylene and natural pulp, Yankee paper, baryta paper, coated papers (especially cast coated papers), metals, cloths and glasses for example.

These supports can be used individually, or supports which have been laminated on one side or on both sides with a synthetic polymer such as polyethylene can also be used.

The supports disclosed on pages 29–31 of JP-A-62-253159 can also be used.

A hydrophilic binder and a semiconductive metal oxide such as tin oxide or alumina sol, carbon black and other anti-static agents may be coated on the surfaces of these supports.

The methods which can be used for exposing and recording an image on the photosensitive element include methods in which the picture of a view or a person is taken directly using a camera; methods in which an exposure is made through a reversal film or a negative film using a printer or an enlarger; methods in which a scanning exposure of an original is made through a slit using the exposing device of a copying machine for example; methods in which the exposure is made with light emitted from a light emitting diode or various types of lasers, being controlled by an electrical signal in accordance with picture information; and methods in which exposures are made directly or via an optical system using image information which is being put out using an image display device such as a CRT, a liquid crystal display, an electroluminescent display or a plasma display.

As indicated above, natural light, tungsten lamps, light emitting diodes, laser light sources, and CRT light sources, for example, the light sources disclosed in column 56 of U.S. Pat. No. 4,500,626, can be used as light sources for recording images on a photosensitive element.

Furthermore, imagewise exposures can also be made using wavelength conversion elements in which a non-linear optical material is combined with a coherent light source such as laser light for example. Here, a non-linear optical material is a material which when irradiated with a strong photoelectric field such as laser light exhibits a non-linearity between the apparent polarization and the electric field. Inorganic compounds as typified by lithium niobate, potassium dihydrogen phosphate (KDP), lithium iodate and $BaB_2O_4$, and urea derivatives, nitroaniline derivatives, nitropyridine-N-oxide derivatives such as 3-methyl-4-nitropyridine-N-oxide (POM) for example, and the compounds disclosed in JP-A-61-53462 and JP-A-62-210432 are preferably used for this purpose. Any of the known embodiments of wavelength converting elements such as the single crystal optical wave guide type and the fiber type can be used.

Furthermore, the aforementioned image information may be an image signal which has been obtained using a video camera or an electronic still camera for example, a television signal as typified by the Nippon Television Signal Code (NTSC), an image signal obtained by dividing an original into a plurality of picture elements using a scanner for example, or an image signal which has been generated using a computer, as typified by CG and CAD for example.

The photosensitive element and/or dye fixing element may be an embodiment which has an electrically conductive heat generating layer as a means of heating for thermal development purposes or for the diffusion transfer of dyes by heating. In such a case a transparent or opaque heat generating element as disclosed in JP-A-61-145544 can be used. Moreover, these electrically conductive layers also function as anti-static layers.

Diffusion transfer photographic materials of the present invention may be processed using the so-called color diffusion transfer method in which image formation is achieved using an alkali processing composition at close to normal temperature, or they may be processed by thermal development. The various known systems can be adopted for the color diffusion transfer method.

Processing by thermal development is described in more detail below.

Thermal development is possible at temperatures of from about 50° C. to about 250° C., but heating temperatures of from about 80° C. to about 180° C. are especially useful in the thermal development process. A dye diffusion transfer process may be carried out at the same time as thermal development, or it may be carried out after the completion of the thermal development process. In the latter case, transfer is possible with heating temperatures for the transfer process within the range from the temperature during the thermal development process to room temperature, but temperatures of at least 50° C. and up to about 10° C. lower than the temperature during the thermal development process are preferred.

Dye transfer can be achieved by heat alone, but solvents may be used in order to promote dye transfer.

Furthermore, the methods in which development and transfer are carried out simultaneously or continuously by heating in the presence of a small amount of solvent (especially water) as described in detail in JP-A-59-218443 and JP-A-61-238056 are also useful. In these methods the heating temperature is preferably at least 50° C. but no higher than the boiling point of the solvent and, for example, when water is used for the solvent a temperature of at least 50° C. but no higher than 100° C. is desirable.

Water or a basic aqueous solution which contains an inorganic alkali metal salt or an organic base (the bases disclosed in the section on image forming accelerators can be used for the base) can be cited as examples of solvents which can be used to accelerate development and/or to transfer a diffusible dye into the dye fixing layer. Furthermore, low boiling point solvents or mixtures of low boiling point solvents with water or basic aqueous solutions, for example, can also be used. Furthermore, surfactants, anti-fogging agents, and sparingly soluble metal salts and complex forming compounds, for example, may be included in the solvent.

These solvents may be applied to the dye fixing element, to the photosensitive element or to both of these elements for use. The amount used should be small, being less than the weight of solvent corresponding to the maximum swelled volume of the whole coated film (in particular, less than the amount obtained on subtracting the weight of the whole coated film from the weight of solvent corresponding to the maximum swelled volume of the whole coated film).

The method described on page 26 of JP-A-61-147244 can be used, for example, for applying the solvent to the photosensitive layer or dye fixing layer. Furthermore, the solvent can also be incorporated for use into the photosensitive element, the dye fixing element or both of these elements beforehand in a form in which it has been enclosed by micro encapsulation.

Furthermore, methods in which a hydrophilic thermal solvent which is a solid at normal temperature but which melts at elevated temperatures is incorporated in the photosensitive element or dye fixing element can also be adopted for accelerating dye transfer. The hydrophilic thermal solvent may be incorporated into the photosensitive element or the dye fixing element, or it may be incorporated into both of these elements. The layer into which it is incorporated may be an emulsion layer, an interlayer, a protective layer or a dye fixing layer, but it is preferably incorporated into a dye fixing layer and/or a layer adjacent thereto.

Examples of hydrophilic thermal solvents include ureas, pyridines, amides, sulfonamides, imides, alcohols, oximes and other heterocyclic compounds.

Furthermore, high boiling point organic solvents may be included in the photosensitive element and/or dye fixing element in order to accelerate dye transfer.

As means of heating the material in the development and/or transfer process, the material may be brought into contact with a heated block or plate, or it may be brought into contact with a hot plate, a hot presser, a heated roller, a halogen lamp heater or an infrared or far-infrared lamp heater for example, or it may be passed through a high temperature atmosphere.

Also, the method in which the photosensitive element and the dye fixing element are pressed together under pressure as disclosed on page 27 of JP-A-61-147244 can be used.

Any of the various thermal development devices can be used for processing the photographic element of the present invention. For example, use of the devices disclosed, for example, in JP-A-59-75247, JP-A-59-177547, JP-A-59-181353, JP-A-60-18951 and JP-A-U-62-25944 is desirable. (The term "JP-A-U" as used herein signifies an "unexamined published Japanese utility model application".)

The invention is described by means of illustrative examples below, but the invention is not limited by these examples.

EXAMPLE 1

A material was prepared with the construction shown in Table 1 as a photosensitive element, and was designated as Photosensitive Element 101.

TABLE 1

Photosensitive Element 101

| Layer Number | Layer Name | | Coated Weight ($mg/m^2$) |
|---|---|---|---|
| Sixth Layer | Protective layer | Gelatin | 900 |
| | | Silica (size 4μ) | 40 |
| | | Zinc hydroxide | 600 |
| | | Surfactant (5) | 130 |
| Fifth Layer | Blue Sensitive Emulsion Layer | Blue sensitive silver halide emulsion | 380 as silver |
| | | Yellow dye providing compound (1) | 400 |
| | | Gelatin | 600 |
| | | Electron donor (1) | 303 |
| | | High boiling point solvent (2) | 200 |
| | | Electron transfer agent precursor (3) | 15 |
| | | Zinc hydroxide | 330 |
| | | Anit-fogging agent (6) | 0.6 |
| Fourth Layer | Interlayer | Gelatin | 700 |
| | | Electron donor (4) | 130 |
| | | High boiling point solvent (2) | 48 |
| | | Surfactant (7) | 61 |
| | | Electron transfer agent (8) | 27 |
| | | Electron transfer agent (9) | 36 |
| | | Film hardening agent (10) | 37 |
| Third Layer | Green Sensitive Emulsion Layer | Green sensitive silver halide emulsion | 220 as silver |
| | | Magenta dye providing compound (2) | 365 |
| | | Gelatin | 310 |
| | | Electron donor (1) | 158 |
| | | High boiling point solvent (2) | 183 |
| | | Electron transfer agent (8) | 27 |
| | | Electron transfer agent precursor (3) | 15 |
| | | Anti-fogging agent (11) | 0.3 |
| Second Layer | Interlayer | Gelatin | 790 |
| | | Zinc hydroxide | 300 |
| | | Electron donor (4) | 130 |
| | | High boiling point sovlent (2) | 73 |
| | | Surfactant (7) | 100 |
| | | Active carbon | 25 |
| First Layer | Red Sensitive Emulsion Layer | Red sensitive silver halide emulsion | 230 as silver |
| | | Cyan dye providing compound (3) | 343 |
| | | Gelatin | 330 |
| | | Electron donor (1) | 163 |
| | | High boiling point solvent (2) | 172 |
| | | Electron transfer agent (8) | 28 |
| | | Electron transfer agent precursor (3) | 17 |
| | | Anti-fogging agent (12) | 0.7 |

Support Poly(ethylene terephthalate) 96μ (Carbon black coated in backing layer)

Surfactant (5)

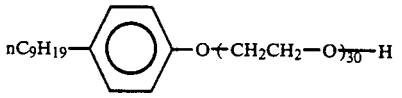

Anti-fogging Agent (6)

-continued
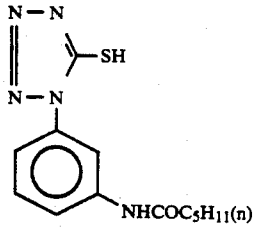
Electron Donor (1)
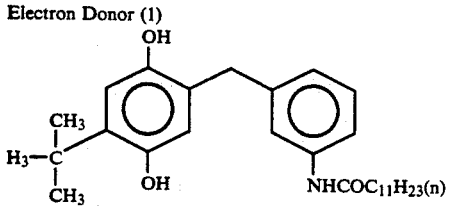
High Boiling Point Solvent (2)
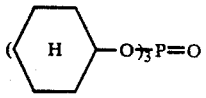
Electron Transfer Agent Precursor (3)
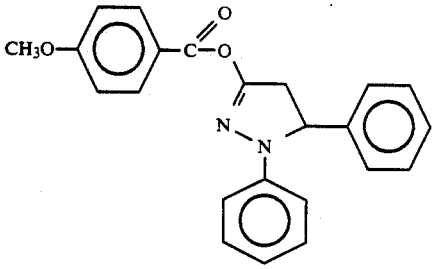
Surfactant (7)
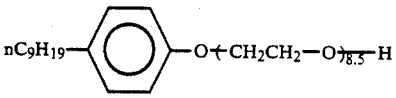
Electron Transfer Agent (8)
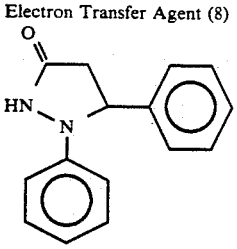
Electron Transfer Agent (9)
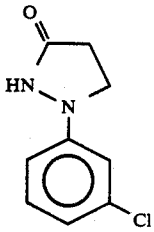
Film Hardening Agent (10)
$CH_2{=}CHSO_2CH_2CONH(CH_2)_2NHCOCH_2SO_2CH{=}CH_2$ (10)-1
$CH_2{=}CHSO_2CH_2CONH(CH_2)_3NHCOCH_2SO_2CH{=}CH_2$ (10)-2
A 3:1 mixture of (10)-1 and (10)-2
Anti-fogging Agent (11)

-continued

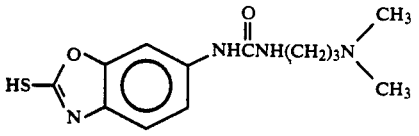

Anti-fogging Agent (12)

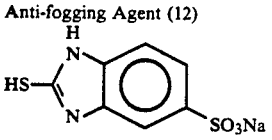

Dye Providing Compound (1)

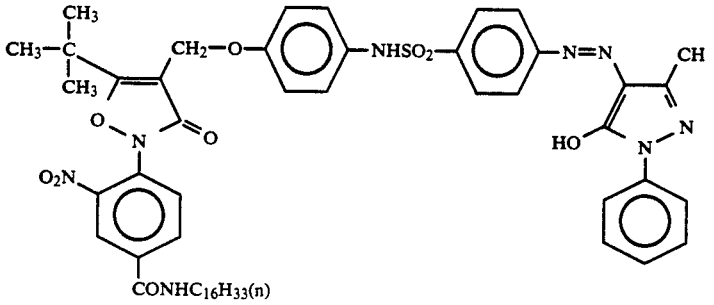

Dye Providing Compound (2)

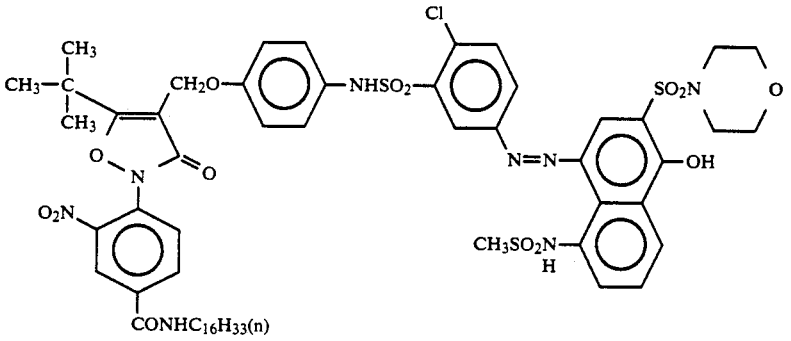

Dye Providing Compound (3)

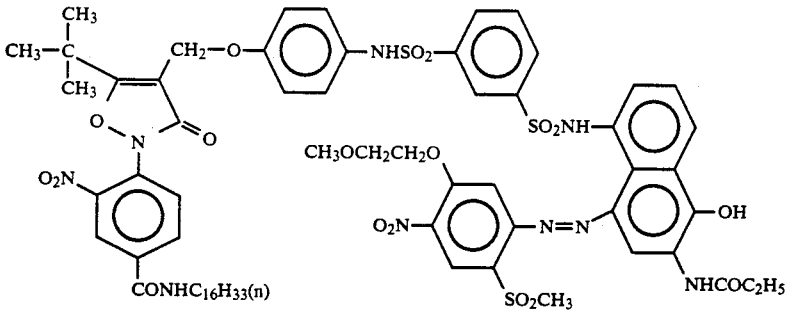

Electron Donor (4)

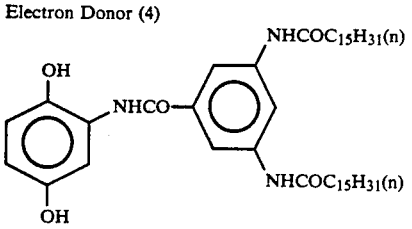

A material was prepared as a dye fixing element which had a layer structure as shown in Table 2, coated on a support of which the structure is shown in Table 3. The fluorescent whitener (1) in the second layer was introduced into the same layer by means of the oil protecting method using high boiling point organic solvent (1), ethyl acetate and sodium dodecylsulfonate in the same layer. This material was taken as Dye Fixing Element 01.

TABLE 2

Structure of Dye Fixing Element 01

| Layer Number | Additive | Amount Added ($g/m^2$) |
|---|---|---|
| Third Layer | Gelatin | 0.05 |
| | Silicone oil (1) | 0.04 |
| | Surfactant (4) | 0.001 |
| | Surfactant (2) | 0.02 |
| | Surfactant (3) | 0.10 |
| | Matting agent (1) | 0.02 |
| | Guanidine picolinate | 0.45 |
| | Wate soluble polymer (1) | 0.24 |
| Second Layer | Mordant (1) | 2.35 |
| | Water soluble polymer (1) | 0.20 |
| | Gelatin | 1.40 |
| | Water soluble polymer (2) | 0.60 |
| | High boiling point solvent (1) | 1.40 |
| | Guanidine picolinate | 2.25 |
| | Fluorescent whitener (1) | 0.05 |
| | Surfactant (1) | 0.15 |
| First Layer | Gelatin | 0.45 |
| | Surfactant (3) | 0.01 |
| | Water soluble polymer (1) | 0.04 |
| | Film hardening agent (1) | 0.30 |
| | Support (1) | |
| First Backing Layer | Gelatin | 3.25 |
| | Film hardening agent (1) | 0.25 |
| Second Backing Layer | Gelatin | 0.44 |
| | Silicone oil (1) | 0.08 |
| | Surfactant (4) | 0.04 |
| | Surfactant (5) | 0.01 |
| | Matting agent (2) | 0.03 |

TABLE 3

Structure of Support (1)

| Layer Name | Composition | | Film Thickness (μ) |
|---|---|---|---|
| Surface Subbing Layer | Gelatin | | 0.1 |
| Surface PE Layer (Glossy) | Low density polyethylene (density 0.923) | 89.2 parts | |
| | Surface treated titanium oxide | 10.0 parts | 20.0 |
| | Ultramarine | 0.8 part | |
| Pulp Layer | Wood-free paper (LBKP/NBKP = 1:1) density 1.080 | | 73.0 |
| Reverse PE Layer (Matt) | High density polyethylene (density 0.960) | | 18.0 |
| Reverse Side Subbing Layer | Gelatin | | 0.05 |
| | Colloidal silica | | 0.05 |
| | | TOTAL | 111.2 |

Properties of Support (1)

| Item | Units | Physical Values | Measurement Method |
|---|---|---|---|
| Rigidity (length/width) | gram | 4.40/3.15 | Taper Rigidity Gauge |
| Whiteness | | L* 94.20<br>A* +0.12<br>B* −2.75 | CIE L*a*b* |

Silicone Oil (1)

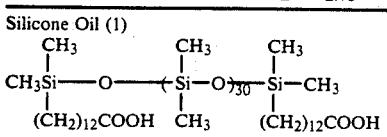

Surfactant (1)

-continued

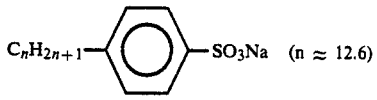

Surfactant (2)

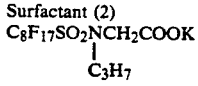

Surfactant (3)

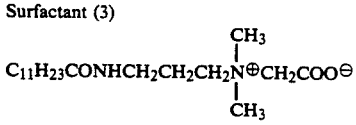

Surfactant (4)

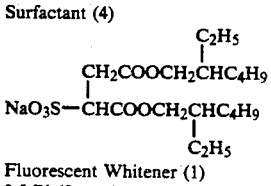

Fluorescent Whitener (1)
2,5-Bis(5-tert-butylbenzoxazole(2))thiophene

Surfactant (5)

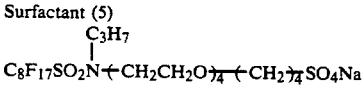

Water Soluble Polymer (1)
Sumikagel L5-H (Made by Sumitomo Chemical Co., Ltd.)
Water Soluble Polymer (2)
Dextran (Molecular weight 70,000)

Mordant (1)

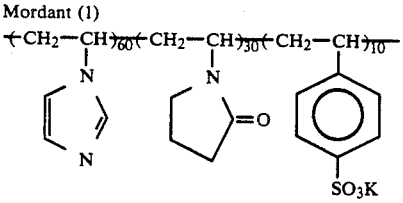

High Boiling Point Solvent (1)

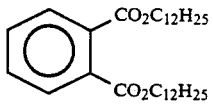

Film Hardening Agent (1)

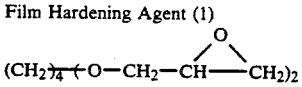

Matting Agent (1)*
Silica
Matting Agent (2)*
Benzoguanidine resin (average particle size 15μ)

Furthermore, Dye Fixing Elements 02 to 30 were prepared in the same way as Dye Fixing Element 01 except that 50 $mg/m^2$ of a compound of the present invention was indicated in Table 4 below was added to the second layer in Dye Fixing Element 01 by means of the oil protecting method, using either the high boiling point solvent (1) as used in Dye Fixing Element 01 or the high boiling point solvent A or B as indicated below.

The above mentioned photosensitive element and dye fixing elements were processed using the image recording apparatus disclosed in JP-A-1-307747. That is to say, a photosensitive element on which a scanning exposure of an original (a test chart on which yellow, magenta, cyan and gray wedges of which the density varied continuously had been recorded) had been made through a slit was immersed in water at a temperature of 35° C. for about 5 seconds, after which it was passed through rollers and immediately laminated with the film surface in contact with the dye fixing element and heated for 15 seconds using a heated roller which was adjusted in such a way that the moistened film surface was heated to 80° C. A clear color image corresponding to the original was obtained on the dye fixing element on subsequently peeling the photosensitive element and the dye fixing element apart.

The density of the white base part of the image was measured immediately after the elements had been peeled apart. This was the magenta density $D_s$. Subsequently, the dye fixing element was left to stand for 24 hours under conditions of 25° C., 50% RH. Then, the density of the white base part was measured again and this was taken as the magenta density $D_t$. The difference in density before and after ageing ($D_t-D_s$) was as shown in Table 4.

High Boiling Point Solvent A

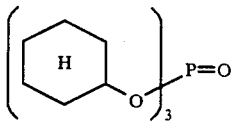

High Boiling Point Solvent B
Enpara 40 (made by Anjinomoto Co., Inc.)
Comparative Compound A

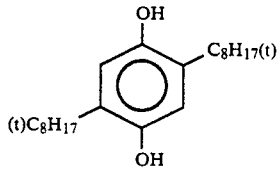

It is clear from Table 4 that the dye fixing elements in which compounds of the present invention had been used exhibited a smaller change in density on ageing than the comparative examples. Thus the invention, as indicted above, is effective.

Furthermore, the same color fixing elements were left to stand for 2 weeks under fluorescent lighting and on observing the change in density of the gray part it was found to be smaller with the dye fixing elements of the present invention than with the comparative examples.

TABLE 4

| Dye Fixing Element | Compound | High Boiling Point Solvent | $D_t$-$D_s$ |
|---|---|---|---|
| 01 (Comp. Ex.) | — | (1) | 0.041 |
| 02 (Comp. Ex.) | Comp. Cpd. A | (1) | 0.039 |
| 03 (Comp. Ex.) | Comp. Cpd. A | A | 0.043 |
| 04 (Comp. Ex.) | Comp. Cpd. A | B | 0.037 |
| 05 (Comp. Ex.) | — | B | 0.040 |
| 06 (Invention) | Compound (1) | A | 0.010 |
| 07 (Invention) | Compound (1) | B | 0.006 |
| 08 (Invention) | Compound (2) | (1) | 0.008 |
| 09 (Invention) | Compound (11) | A | 0.011 |
| 10 (Invention) | Compound (11) | B | 0.006 |
| 11 (Invention) | Compound (16) | A | 0.012 |
| 12 (Invention) | Compound (20) | A | 0.017 |
| 13 (Invention) | Compound (20) | (1) | 0.012 |
| 14 (Invention) | Compound (26) | A | 0.017 |
| 15 (Invention) | Compound (36) | A | 0.016 |

TABLE 4-continued

| Dye Fixing Element | Compound | High Boiling Point Solvent | $D_t$-$D_s$ |
|---|---|---|---|
| 16 (Invention) | Compound (41) | A | 0.010 |
| 17 (Invention) | Compound (46) | B | 0.011 |
| 18 (Invention) | Compound (52) | A | 0.024 |
| 19 (Invention) | Compound (62) | A | 0.022 |
| 20 (Invention) | Compound (62) | (1) | 0.018 |
| 21 (Invention) | Compound (78) | A | 0.16 |
| 22 (Invention) | Compound (80) | B | 0.14 |
| 23 (Invention) | Compound (82) | A | 0.11 |
| 24 (Invention) | Compound (81) | B | 0.09 |
| 25 (Invention) | Compound (89) | B | 0.08 |
| 26 (Invention) | Compound (94) | A | 0.12 |
| 27 (Invention) | Compound (94) | B | 0.07 |
| 28 (Invention) | Compound (97) | A | 0.13 |
| 29 (Invention) | Compound (101) | A | 0.14 |
| 30 (Invention) | Compound (101) | B | 0.11 |

EXAMPLE 2

Dye fixing elements were prepared in the same way as in Example 1 except that the fluorescent whitener in the second layer of the dye fixing element in Example 1 was not used.

The results obtained were more or less the same as those obtained in Example 1.

EXAMPLE 3

Photosensitive Element 201 was prepared in the same way as Photosensitive Element 101 except that the electron transfer agent precursor in Photosensitive Element 101 in Example 1 was omitted.

Furthermore, Photosensitive Element 202 was prepared in the same way as Photosensitive Element 101, except that the electron transfer agent precursor in Photosensitive Element 101 of Example 1 was omitted and replaced with an equimolar amount of the electron transfer agent indicated below.

These photosensitive elements were each combined with the dye fixing elements prepared in Example 1 and the results obtained on testing in the same way as in Example 1 were more or less the same as those obtained in Example 1.

Electron transfer agent

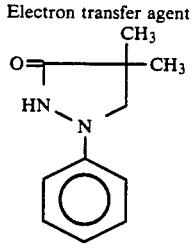

EXAMPLE 4

A material whose layer structure is shown in Table 5 was prepared as a photosensitive element and this was taken as Photosensitive Element 401.

TABLE 5

| Layer Number | Layer Name | Additive | Coated Weight (mg/m²) |
|---|---|---|---|
| Tenth Layer | Protective Layer | Gelatin | 0.17 |
| | | Matting agent (1) | 0.09 |
| | | Film hardening agent (1) | $1.9 \times 10^{-3}$ |
| | | Surfactant (1) | $4.5 \times 10^{-4}$ |
| | | Surfactant (2) | $5.0 \times 10^{-5}$ |

TABLE 5-continued

| Layer Number | Layer Name | Additive | Coated Weight (mg/m²) |
|---|---|---|---|
| | | Water soluble polymer (1) | $3.6 \times 10^{-4}$ |
| Ninth Layer | Ultraviolet Absorbing Layer | Gelatin | 0.47 |
| | | Ultraviolet absorber (1) | 0.14 |
| | | Ultraviolet absorber (2) | 0.13 |
| | | Surfactant (1) | $1.3 \times 10^{-3}$ |
| | | Water soluble polymer (1) | $1.4 \times 10^{-4}$ |
| Eighth Layer | Blue Sensitive Layer | Emulsion (I) | 0.23 (as silver) |
| | | Gelatin | 0.34 |
| | | Surfactant (1) | $6.7 \times 10^{-3}$ |
| | | Water soluble polymer (1) | $1.4 \times 10^{-2}$ |
| Seventh Layer | Yellow Color Material Layer | Yellow dye providing substance (1) | 0.37 |
| | | Electron donor (1) | 0.20 |
| | | Gelatin | 0.53 |
| | | High boiling point organic solvent (1) | 0.37 |
| | | Water soluble polymer (1) | $6.5 \times 10^{-3}$ |
| Sixth Layer | Interlayer | Reducing agent (1) | 0.45 |
| | | High boiling point organic solvent (1) | 0.16 |
| | | Gelatin | 0.68 |
| | | Surfactant (2) | $6.5 \times 10^{-2}$ |
| | | Water soluble polymer (1) | $1.9 \times 10^{-2}$ |
| Fifth Layer | Green Sensitive Layer | Emulsion (II) | 0.23 (as silver) |
| | | Gelatin | 0.34 |
| | | Surfactant (1) | $6.7 \times 10^{-3}$ |
| | | Water soluble polymer (1) | $1.4 \times 10^{-2}$ |

TABLE 5-continued

| Layer Number | Layer Name | Additive | Coated Weight (mg/m²) |
|---|---|---|---|
| Fourth Layer | Magenta Color Material Layer | Magenta dye providing substance (2) | 0.33 |
| | | Electron donor (1) | 0.13 |
| | | Gelatin | 0.38 |
| | | High boiling point organic solvent (1) | 0.27 |
| | | Water soluble polymer (1) | $4.3 \times 10^{-3}$ |
| Third Layer | Interlayer | Reducing agent (1) | 0.45 |
| | | High boiling point organic solvent (1) | 0.16 |
| | | Gelatin | 0.68 |
| | | Surfactant (2) | $6.5 \times 10^{-2}$ |
| | | Water soluble polymer (1) | $1.9 \times 10^{-2}$ |
| Second Layer | Red Sensitive Layer | Emulsion (III) | 0.23 (as silver) |
| | | Gelatin | 0.34 |
| | | Surfactant (1) | $6.7 \times 10^{-3}$ |
| | | Water soluble polymer (1) | $1.4 \times 10^{-2}$ |
| First Layer | Cyan Color Material Layer | Cyan dye providing substance (3) | 0.38 |
| | | Electron donor (1) | 0.13 |
| | | Gelatin | 0.38 |
| | | High boiling point organic solvent (1) | 0.27 |
| | | Water soluble polymer (1) | $4.3 \times 10^{-3}$ |
| | Support (Poly(ethylene terephthalate) 100 μm) | | |
| Backing Layer | | Carbon black | 4.0 |
| | | Gelatin | 2.0 |

Matting Agent (1)
Poly(methyl methacrylate) spherical latex
(Average particle size 4μ)
Ultraviolet Absorber (1)

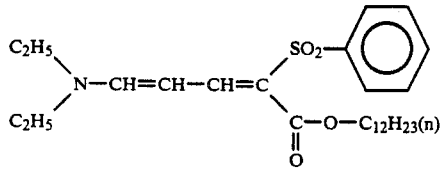

Ultraviolet Absorber (2)

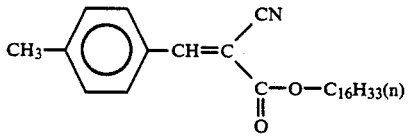

Water Soluble Polymer (1)

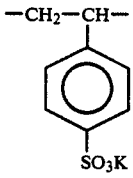

Surfactant (1)
Aerosol OT
Surfactant (2)

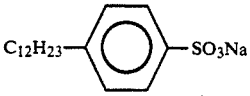

High Boiling Point Organic Solvent (1)

-continued
Tricyclohexyl phosphate
Film Hardening Agent (1)
1,2-Bis(vinylsulfonylacetamido)ethane
Reducing Agent (1)
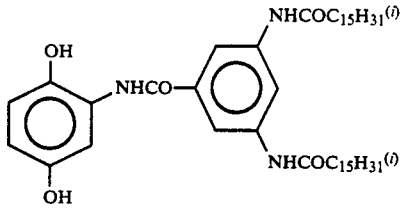
Electron Donor (1)
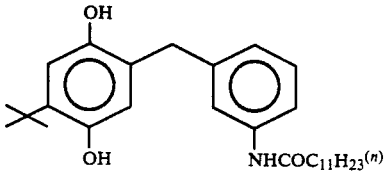
Yellow Dye Providing Substance (1)
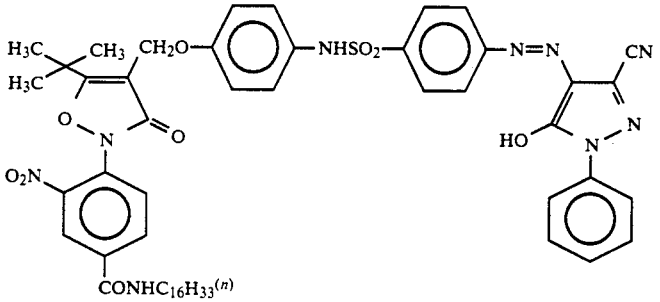
Magenta Dye Providing Substance (2)
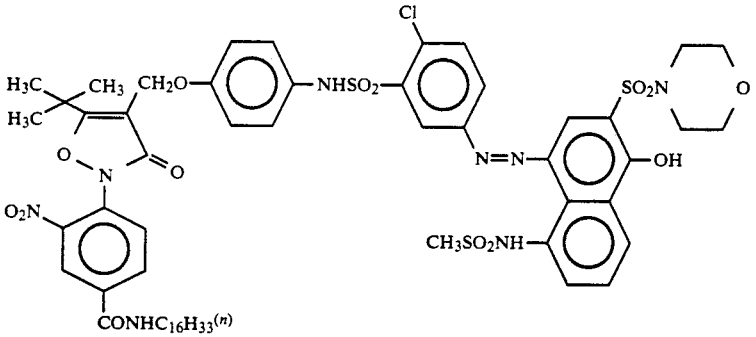
Cyan Dye Providing Substance (3)
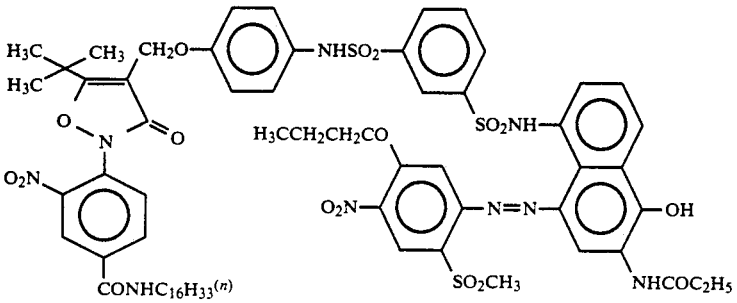

The preparation of emulsion (I) used in the eighth layer is described below.

Solutions (I) and (II) indicated below were added simultaneously at an even flow rate over a period of 30 minutes to a thoroughly agitated aqueous gelatin solution (a solution obtained by adding 20 grams of gelatin, 0.3 gram of potassium bromide, 6 grams of sodium chloride and 30 mg of reagent A indicated below to 800 ml of water and maintaining at a temperature of 50° C). Subsequently, solutions (III) and (IV) indicated below were added simultaneously over a period of 30 minutes. Furthermore, the dye solution indicated below was added over a period of 20 minutes starting 3 minutes after the commencement of the addition of solutions (III) and (IV).

After washing with water and desalting, 22 grams of lime treated ossein gelatin was added and, after adjustment to pH 6.2 and pAg 7.7, sodium thiosulfate, 4-hydroxy-6-methyl-1,3,3a,7-tetraazaindene and chloroauric acid were added and the emulsion was chemically sensitized optimally at 60° C. A mono-disperse cubic silver chlorobromide emulsion of average grains size 0.38 μ was obtained in this way. The yield was 635 grams.

| | Solution (I) Water Added to Make 200 ml | Solution (II) Water Added to Make 200 ml |
|---|---|---|
| $AgNO_3$ | 50.0 grams | — |
| KBr | — | 28.0 grams |
| NaCl | — | 3.4 grams |
| | **Solution (III) Water Added to Make 200 ml** | **Solution (IV) Water Added to Make 200 ml** |
| $AgNO_3$ | 50.0 grams | — |
| KBr | — | 35.0 grams |

Reagent A

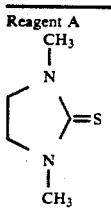

Dye Solution

The dye solution was obtained by dissolving 67 mg of dye (a) indicated below and 133 mg of dye (b) indicated below in 100 ml of methanol.

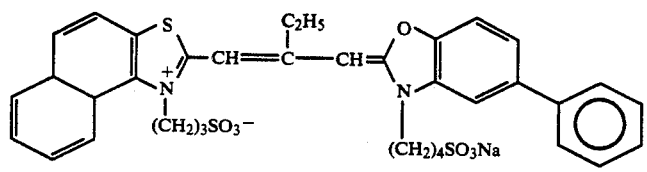

Dye (a)

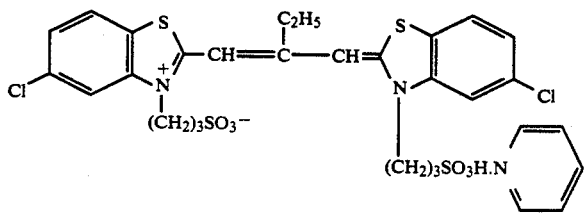

Dye (b)

The preparation of emulsion (II) used in the fifth layer is described below.

Solution (I) and solution (II) shown in Table B were added over a period of 30 minutes to a thoroughly agitated aqueous gelatin solution (Table A) which was being maintained at 50° C. Next, solution (III) and solution (IV) shown in Table B were added over a period of 30 minutes and the dye solution shown in Table C was added 1 minute after completion of this addition.

TABLE A

| | |
|---|---|
| Gelatin | 20 grams |
| NaCl | 6 grams |
| KBr | 0.3 gram |
| 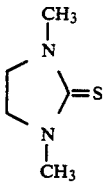 | 0.015 gram |
| $H_2O$ | 730 ml |

TABLE B

| | (I) | (II) | (III) | (IV) |
|---|---|---|---|---|
| $AgNO_3$ | 50 grams | — | 50 grams | — |
| KBr | — | 21 grams | — | 28 grams |
| NaCl | — | 6.9 grams | — | 3.5 grams |
| $H_2O$ added to make: | 200 cc | 200 cc | 200 cc | 200 cc |

TABLE C (Composition of the Dye Solution)

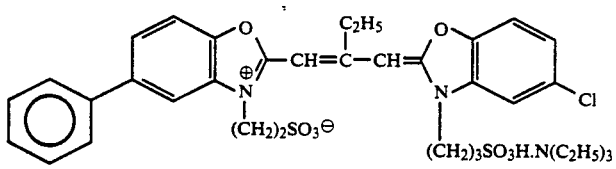

0.18 g

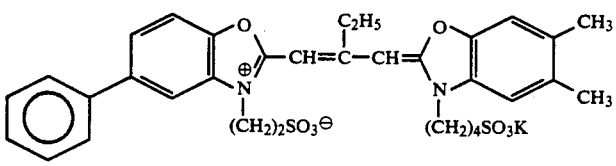

0.02 g

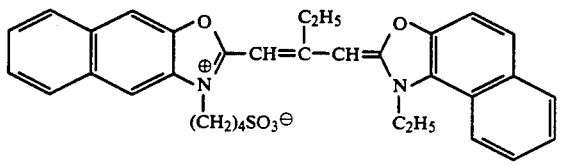

0.035 g

Methanol 154 cc

After washing with water and desalting, 20 grams of gelatin was added, the pH and pAg values were adjusted and chemical sensitization was carried out optimally using triethylthiourea, chloroauric acid and 4-hydroxy-6-methyl-1,3,3a,7-tetraazaindene.

The emulsion obtained was a 0.40 μ mono-disperse cubic emulsion and the yield was 630 grams.

The preparation of emulsion (III) used in the second layer is described below.

Solution (I) and solution (II) indicated below were added simultaneously over a period of 30 minutes to a thoroughly agitated aqueous gelatin solution (obtained by adding 20 grams of gelatin, 3 grams of potassium bromide, 0.03 gram of compound (1) indicated below and 0.25 gram of $HO(CH_2)_2S(CH_2)_2S(CH_2)_2OH$ to 800 cc of water and maintaining at 50° C.). Subsequently, solution (III) and solution (IV) indicated below were added simultaneously over a period of 20 minutes. Furthermore, the dye solution indicated below was added over a period of 18 minutes starting 5 minutes after the commencement of the addition of solution (III) and solution (IV).

After washing with water and desalting, 20 grams of lime treated ossein gelatin was added and, after adjusting to pH 6.2 and pAg 8.5, sodium thiosulfate, 4-hydroxy-6-methyl-1,3,3a,7-tetraazaindene and chloroauric acid were added and the mixture was chemically sensitized optimally. Six hundred grams of a monodisperse cubic silver chlorobromide emulsion of average grain size 0.40 μ was obtained in this way.

| | Solution (I) in Water 180 ml | Solution (II) in Water 180 ml | Solution (III) in Water 350 ml | Solution (IV) in Water 350 ml |
|---|---|---|---|---|
| $AgNO_3$ | 30 grams | — | 70 grams | — |
| KBr | — | 17.8 grams | — | 49 grams |
| NaCl | — | 1.6 grams | — | — |

Dye Solution 0.18 gram

-continued

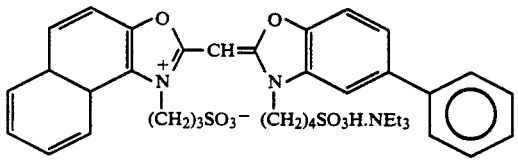

0.06 gram

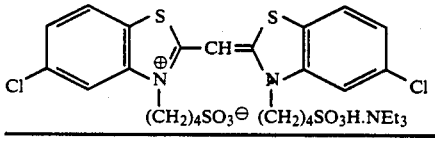

The dye solution was obtained by dissolving the dyes indicated above in 160 cc of methanol.

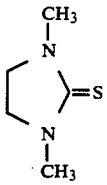

Compound (1)

The preparation of the gelatin dispersion of the dye providing substance is described below.

The yellow dye providing compound (1) (18 grams) and 12 grams of high boiling point solvent (1) were weighed out, 51 ml of ethyl acetate was added and a uniform solution was obtained by heating to about 60° C. A 10% aqueous lime treated gelatin solution (100 grams), 60 cc of water and 1.5 grams of sodium dodecylbenzenesulfonate were mixed with this solution with stirring and then the mixture was dispersed at 10,000 rpm for 10 minutes in a homogenizer. This dispersion is referred to as the yellow dye providing substance dispersion.

The magenta and cyan dye providing substance dispersions were obtained in the same way as the yellow dye providing substance dispersion using the magenta dye providing substance (2) or the cyan dye providing substance (3), respectively.

The preparation of the gelatin dispersion of the electron donor is described below.

The electron donor (1) (20.6 grams) and 13.1 grams of high boiling point solvent (1) were weighed out, 120 ml of ethyl acetate was added and a uniform solution was obtained by heating to about 60° C. A 10% aqueous lime treated gelatin solution (100 grams), 60 cc of water and 1.5 grams of sodium dodecylbenzenesulfonate were mixed with this solution with stirring and then the mixture was dispersed at 10,000 rpm for 10 minutes in a homogenizer. This dispersion is referred to as the electron donor dispersion.

The preparation of the gelatin dispersion of the reducing agent for preventing the occurrence of color mixing is described below.

The reducing agent (1) (23.5 grams) and 8.5 grams of high boiling point organic solvent (1) were dissolved by heating to about 60° C. in 120 ml of ethyl acetate and a uniform solution was obtained. This solution was mixed, with stirring, with 100 grams of a 10% aqueous lime treated gelatin solution, 15 ml of a 5% aqueous solution of surfactant (3) and 0.2 gram of sodium dodecylbenzenesulfonate and then dispersed at 10,000 rpm for 10 minutes in a homogenizer. The dispersion obtained is referred to as the reducing agent dispersion for preventing color mixing.

Image Receiving Material 402 was prepared as indicated below.

Paper Support

The paper support was obtained by laminating polyethylene to a thickness of 30 μ on both sides of a paper of thickness 150 μ. Titanium oxide (10% by weight with respect to the polyethylene) was added to and dispersed in the polyethylene on the image receiving layer side of the support.

Reverse Side

The following layers (a) to (c) were coated successively on the reverse side of the support and the films were hardened using a film hardening agent.

(a) A light shielding layer comprised of 4.0 g/m² of carbon black and 2.0 g/m² of gelatin.

(b) A white layer comprised of 8.0 g/m² of titanium oxide and 1.0 g/m² of gelatin.

(c) A protective layer comprised of 0.6 g/m² of gelatin.

Image Receiving Layer Side

The following layers (1) to (6) were coated in the order listed on the support and the film was hardened using a film hardening agent.

(1) A neutralizing layer containing 22 g/m² of an acrylic acid/butyl acrylate (mol ratio 8:2) copolymer of average molecular weight 50,000.

(2) A second timing layer containing 4.5 g/m² of a mixture in the proportions by weight of 95:5 of 51.3% acidified cellulose acetate (the weight of acetic acid released on hydrolysis was 0.513 grams per gram of sample) and a copolymer of styrene and maleic anhydride (mol ratio 1:1) of average molecular weight about 10,000.

(3) An interlayer containing 0.4 g/m² of poly(2-propoxyethyl methacrylate)

(4) A first timing layer containing 1.6 g/m² as a total solids content of a blend in the proportions, as solids contents, of 6:4 of a polymer latex obtained by the emulsion polymerization of styrene/butyl acrylate/acrylic acid/N-methylolacrylamide in the proportions by weight of 49.7/42.3/4/4 and a polymer latex obtained by the emulsion polymerization of methyl methacrylate/acrylic acid/N-methylolacrylamide in the proportions by weight of 93/3/4.

(5) An image receiving layer made by coating 3.0 g/m² of a polymer mordant which had the repeating unit indicated below and 3.0 g/m² of gelatin, using the surfactant indicated below as a coating promotor.

Surfactant:

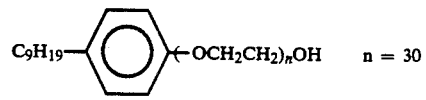

Repeating Unit

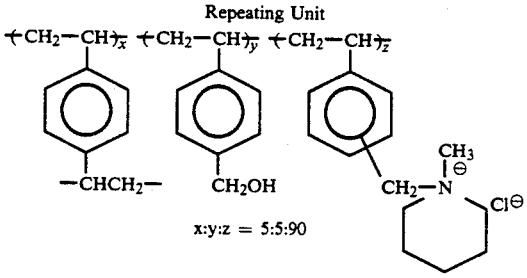

(6) A protective layer established by coating 0.6 g/m² of gelatin.

The formulation of the processing solution is indicated below.

The processing solution (0.8 gram) of which the composition is indicated below was packed into a rupturable container.

| | |
|---|---|
| 1-p-Tolyl-4-hydroxymethyl-4-methyl-3-pyrazolidone | 10.0 grams |
| 1-Phenyl-4-hydroxymethyl-4-methyl-3-pyrazolidone | 4.0 grams |
| Potassium sulfite (anhydrous) | 4.0 grams |
| Hydroxyethyl cellulose | 40 grams |
| Potassium hydroxide | 64 grams |
| Benzyl alcohol | 2.0 grams |
| Water to make up to a total weight of | 1 kg |

The aforementioned photosensitive material was exposed from the emulsion layer side and then laminated on the image receiving layer side of the image receiving material and the above mentioned processing solution was spread between the two materials in the form of a layer of thickness 60 μ with the aid of a pressure roller. Processing was carried out at 25° C. and the image receiving material was peeled away from the photosensitive material after 1.5 minutes.

Next, Image Receiving Material 403 was prepared in the same way as Image Receiving Material 402 except that 1.2 g/m² (as the weight of S-1) of an emulsified dispersion of the phthalic acid ester indicated below (S-1) was added to the image receiving layer (5).

Moreover, Image Receiving Materials 404 to 410 were obtained in the same way as Image Receiving Material 402 except that 1.2 g/m² of S-1, or S-2, and 100 g/m² (as the weight of compound) of an emulsified dispersion of the compounds of the present invention or comparative compounds shown in Table 6 were added.

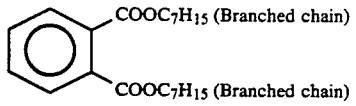

S-1

Chlorinated Paraffin (Enpara 40, made by Ajinomoto Co., Inc.) S-2

The difference in the magenta density of the white base part 30 seconds and 12 hours after peeling apart (the material was left to stand under conditions of 25° C., 50% RH) is shown in Table 6.

It is clear from Table 6 that the occurrence of staining was inhibited in Samples 404 to 409 in which compounds of the present invention had been used when compared with the comparative samples.

TABLE 6

| Image Receiving Material | Emulsified Dispersion | Difference in Magenta Density |
|---|---|---|
| 402 | — | 0.21 |
| 403 | S-1 — | 0.19 |
| 404 | S-1 Cpd. (1) of the invention | 0.14 |
| 405 | S-1 Cpd. (20) of the invention | 0.13 |
| 406 | S-1 Cpd. (81) of the invention | 0.10 |
| 407 | S-1 Cpd. (94) of the invention | 0.11 |
| 408 | S-2 Cpd. (20) of the invention | 0.12 |
| 409 | S-2 Cpd. (81) of the invention | 0.09 |
| 410 | S-1 Comparative Cpd. S-3 | 0.17 |

S-3

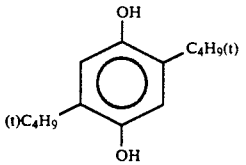

While the invention has been described in detail and with reference to specific embodiments thereof, it will be apparent to one skilled in he art that various changes and modifications can be made therein without departing from the spirit and scope thereof.

What is claimed is:

1. A dye fixing element to which a diffusible dye is transferable, the dye having been formed or released during development, either after or at the same time as imagewise exposure of a photosensitive element, which photosensitive element comprises a photosensitive silver halide, a binder and a dye-providing compound which forms or releases a diffusible dye in correspondence or counter-correspondence to the exposure, wherein the dye fixing element comprises a polymer mordant and at least one compound represented by general formula (I):

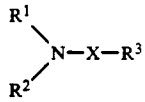

(I)

where $R^1$ and $R^2$, which may be the same or different, each represents a hydrogen atom, an alkyl group, an alkenyl group, an alkynyl group, an aryl group

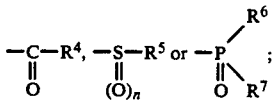

$R^3$ represents a hydrogen atom;

X represents —O—

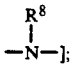

$R^4$, $R^5$, $R^6$ and $R^7$ each represents an alkyl group, an alkenyl group and alkynyl groups, an aryl group, an alkoxy group, an aryloxy group or an amino group;

n represents 1 or 2;

and the total number of carbon atoms of the compound represented by general formula (I) is at least 6.

2. The dye fixing element of claim 1, in which the compound of general formula (I) has been introduced into the dye fixing element using an oil protecting method.

3. The dye fixing element of claim 1, in which the amount of the compound of general formula (I) in the element is from 0.1 to 500 mg/m².

4. The dye fixing element of claim 1, in which the amount of the compound of general formula (I) in the element is from 2 to 200 mg/m².

5. The dye fixing element of claim 1, wherein the polymer mordant is selected from the group consisting of polymers containing either a tertiary amino group or a quaternary cation of a tertiary amino group, and polymers having either a nitrogen-containing heterocyclic group or a quaternary cation of a nitrogen-containing heterocyclic group.

6. The dye fixing element of claim 5, further comprising a polyvalent ion of a transition metal.

* * * * *